US011993988B2

(12) United States Patent
Magnuson

(10) Patent No.: US 11,993,988 B2
(45) Date of Patent: May 28, 2024

(54) TORQUE WRENCH

(71) Applicant: NABORS DRILLING TECHNOLOGIES USA, INC., Houston, TX (US)

(72) Inventor: Christopher Magnuson, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 393 days.

(21) Appl. No.: 17/326,078

(22) Filed: May 20, 2021

(65) Prior Publication Data

US 2021/0363838 A1 Nov. 25, 2021

Related U.S. Application Data

(60) Provisional application No. 63/027,534, filed on May 20, 2020.

(51) Int. Cl.
*E21B 19/16* (2006.01)

(52) U.S. Cl.
CPC ..... *E21B 19/163* (2013.01)

(58) Field of Classification Search
CPC ..... E21B 19/163; E21B 19/16
See application file for complete search history.

(56) References Cited

U.S. PATENT DOCUMENTS 4,403,897 A * 9/1983 Willis ..... E21B 19/155 414/745.2
5,099,725 A 3/1992 Bouligny, Jr. et al.
5,537,900 A 7/1996 Schaar
6,263,763 B1 * 7/2001 Feigel, Jr. ..... E21B 19/166 81/57.35
7,062,991 B1 * 6/2006 West ..... E21B 19/18 81/57.16
7,121,166 B2 * 10/2006 Drzewiecki ..... E21B 19/163 81/57.33
7,188,547 B1 * 3/2007 West ..... E21B 19/161 81/57.16
7,313,986 B2 * 1/2008 West ..... E21B 19/163 81/57.16
7,464,612 B2 12/2008 Manella et al.
8,235,104 B1 * 8/2012 Sigmar ..... E21B 19/164 166/85.1
8,424,419 B2 4/2013 Connell
(Continued)

FOREIGN PATENT DOCUMENTS

CA 2726637 A1 12/2009
CA 2773295 C 5/2015
(Continued)

*Primary Examiner* — David B. Thomas
(74) *Attorney, Agent, or Firm* — Abel Schillinger, LLP

(57) ABSTRACT

A system with a wrench coupled to a rig floor, and the wrench can include a plurality of grippers, a linkage mechanism that couples the plurality of grippers together, and a plurality of actuators coupled to the linkage mechanism, with the plurality of actuators used to apply a force to the linkage mechanism in opposite directions, and with the linkage mechanism configured to evenly distribute the force between the plurality of grippers. The wrench can support a torque wrench or a backup tong of an iron roughneck.

20 Claims, 16 Drawing Sheets

(56) References Cited

U.S. PATENT DOCUMENTS

| | | | | |
|---|---|---|---|---|
| 8,474,806 | B2 * | 7/2013 | Orgeron | B25B 5/147 269/45 |
| 8,601,910 | B2 | 12/2013 | Begnaud | |
| 8,733,213 | B2 | 5/2014 | Taggart | |
| 8,777,199 | B2 | 7/2014 | Webb | |
| 9,328,571 | B2 | 5/2016 | Taggart | |
| 10,006,260 | B2 | 6/2018 | Webre et al. | |
| 10,309,169 | B2 | 6/2019 | Scekic et al. | |
| 10,329,857 | B2 * | 6/2019 | Hunter | E21B 19/164 |
| 10,538,976 | B2 | 1/2020 | Scekic et al. | |
| 10,557,321 | B2 | 2/2020 | Scekic et al. | |
| 10,689,925 | B2 * | 6/2020 | Angelle | E21B 19/164 |
| 10,718,171 | B2 | 7/2020 | McCorriston et al. | |
| 10,767,425 | B2 * | 9/2020 | Meuth | E21B 19/161 |
| 10,808,469 | B2 * | 10/2020 | Vo | B25B 13/488 |
| 11,608,694 | B2 | 3/2023 | McCorriston et al. | |
| 2003/0205112 | A1 | 11/2003 | Hawkins, III | |
| 2005/0241441 | A1 | 11/2005 | Drzewiecki | |
| 2015/0090463 | A1 | 4/2015 | Gupta et al. | |
| 2018/0347295 | A1 | 12/2018 | Vo | |
| 2018/0347296 | A1 * | 12/2018 | Vo | E21B 19/161 |
| 2020/0047336 | A1 | 2/2020 | Savini et al. | |
| 2020/0063506 | A1 | 2/2020 | Helms et al. | |
| 2020/0063507 | A1 | 2/2020 | Thiemann | |
| 2022/0090454 | A1 | 3/2022 | Taggart et al. | |
| 2023/0203898 | A1 | 6/2023 | McCorriston et al. | |

FOREIGN PATENT DOCUMENTS

| | | | |
|---|---|---|---|
| EP | 2851504 | B1 | 3/2015 |
| EP | 3141690 | B1 | 3/2017 |
| WO | 2017/100913 | A1 | 6/2017 |

* cited by examiner

TORQUE WRENCH

CROSS-REFERENCE TO RELATED APPLICATION(S)

This application claims priority under 35 U.S.C. § 119(e) to U.S. Provisional Patent Application No. 63/027,534, entitled "TORQUE WRENCH," by Christopher MAGNUSON, filed May 20, 2020, which application is assigned to the current assignee hereof and incorporated herein by reference in its entirety.

TECHNICAL FIELD

The present invention relates, in general, to the field of drilling and processing of wells. More particularly, present embodiments relate to a system and method for making or breaking joint connections in a tubular string during subterranean operations.

BACKGROUND

Iron Roughnecks as well as other tubular manipulators have devices for gripping, holding, spinning, or torquing tubulars during subterranean operations (e.g., drilling, treating, completing, producing, or abandoning a wellbore). These operations may require assembling or disassembling a tubular string that extends into the wellbore from a rig floor. As the tubular string is being extended into the wellbore, successive tubulars are connected to the top end of the tubular string to lengthen it and extend it further into the wellbore. As the tubular string is being disassembled into individual tubulars, the process is reversed with the tubular string being successively pulled from the wellbore at an appropriate distance to remove the next tubular by breaking loss a joint.

Each connection forms a joint, where the joint can include a pin end of a tubular threaded into a box end of the tubular string. To prevent failures of the joint as the tubular string is being used, there are industry standard torque requirements that should be applied to each joint as the joint is being made up to ensure proper operation of the tubular string. If these torque requirements are not met, then the joint may prematurely separate causing failure of the joint and thus failure of the tubular string. Larger diameters tubulars may require up to 120,000 ft-lbs (162.7 Kn-m) of force applied to the joint to torque the joint to the specified torque requirements. This massive amount of force is applied by torque wrenches in the tubular handling equipment such as iron roughnecks, make-up/break-up tongs, etc. The iron roughnecks are generally used to assemble/disassemble the tubular string at the well center, which can be considered an "online" operation since its operation directly impacts rig time. The make-up/break-up tongs are generally used "offline" to build tubular stands (e.g., connect two or more tubulars together to form a tubular stand) which can be stored in horizontal or vertical storage in preparation for supporting the subterranean operations.

The tubular handling equipment required to deliver up to 120K ft-lbs (162.7 Kn-m) of force tends to be very large, and this poses design challenges for equipment, such as iron roughnecks, that may be manipulated by a robotic arm pivotably mounted to a rig floor. The weight and size of the torque wrenches to support the specified torque requirements.

Therefore, improvements of tubular handling equipment are continually needed, and particularly improvements for the weight and size of torque wrenches used in support of subterranean operations.

SUMMARY

In accordance with an aspect of the disclosure, a system for conducting a subterranean operation is provided that can include a wrench coupled to a rig floor, where the wrench can include a plurality of grippers, a linkage mechanism that couples the plurality of grippers together, and a plurality of actuators coupled to the linkage mechanism, wherein the plurality of actuators apply a force to the linkage mechanism in opposite directions, and wherein the linkage mechanism is configured to evenly distribute the force between the plurality of grippers.

In accordance with another aspect of the disclosure, a system for conducting a subterranean operation is provided that can include a wrench that can include a body having an opening configured to receive a tubular, the opening having a center axis, a plurality of grippers circumferentially spaced apart around the opening, a linkage mechanism that couples the plurality of grippers together, a plurality of actuators coupled to the linkage mechanism, and a piston assembly coupled to the linkage mechanism, where the extension of the plurality of actuators moves the piston assembly, via the linkage mechanism, toward the center axis and retraction of the plurality of actuators moves the piston assembly, via the linkage mechanism, away from the center axis.

In accordance with another aspect of the disclosure, a system for conducting a subterranean operation is provided that can include an iron roughneck that can include a torque wrench and a backup tong, with each of the torque wrench and the backup tong comprising, a body, a plurality of grippers, a linkage mechanism that couples the plurality of grippers together, and a plurality of actuators coupled to the linkage mechanism, with one of the plurality of grippers removably attached to a piston assembly, with the piston assembly comprising, a piston slidably coupled to a bore of a support attached to the body, a coupling that couples the piston assembly to the linkage mechanism, the coupling being slidably coupled to the piston, and a biasing device that urges the piston toward the coupling, where the bore is configured to allow the piston to extend toward a center axis of an opening in the iron roughneck and prevent the piston from retracting more than a predetermined distance away from the center axis.

In accordance with another aspect of the disclosure, a method for making or breaking a joint in a tubular string is provided, where the method can include operations of receiving a joint of the tubular string into an opening of a roughneck, the opening having a center axis and the roughneck comprising a torque wrench and a backup tong, each comprising, a plurality of grippers, a linkage mechanism that couples the plurality of grippers together, and left and right actuators coupled to the linkage mechanism, extending the left and right actuators of the backup tong in opposite directions; thereby extending the plurality of grippers of the backup tong toward the center axis, engaging the joint with the plurality of grippers of the backup tong, and equalizing, via the linkage mechanism, a gripping force supplied by of each of the plurality of grippers of the backup tong to the joint.

In accordance with another aspect of the disclosure, a system for conducting a subterranean operation is provided that can include a wrench coupled to a rig floor, where the wrench can include a plurality of grippers, comprising first, second, and third grippers, the second gripper configured to be mounted to a piston body having a longitudinal center axis, a linkage mechanism that couples the plurality of grippers together, and a plurality of actuators coupled to the linkage mechanism, wherein each of the plurality of actuators apply a force to the linkage mechanism in a direction that is perpendicular to the longitudinal center axis, and wherein the linkage mechanism is configured to evenly distribute the force between the plurality of grippers.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description, in combination with the figures, is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about," "approximately," or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
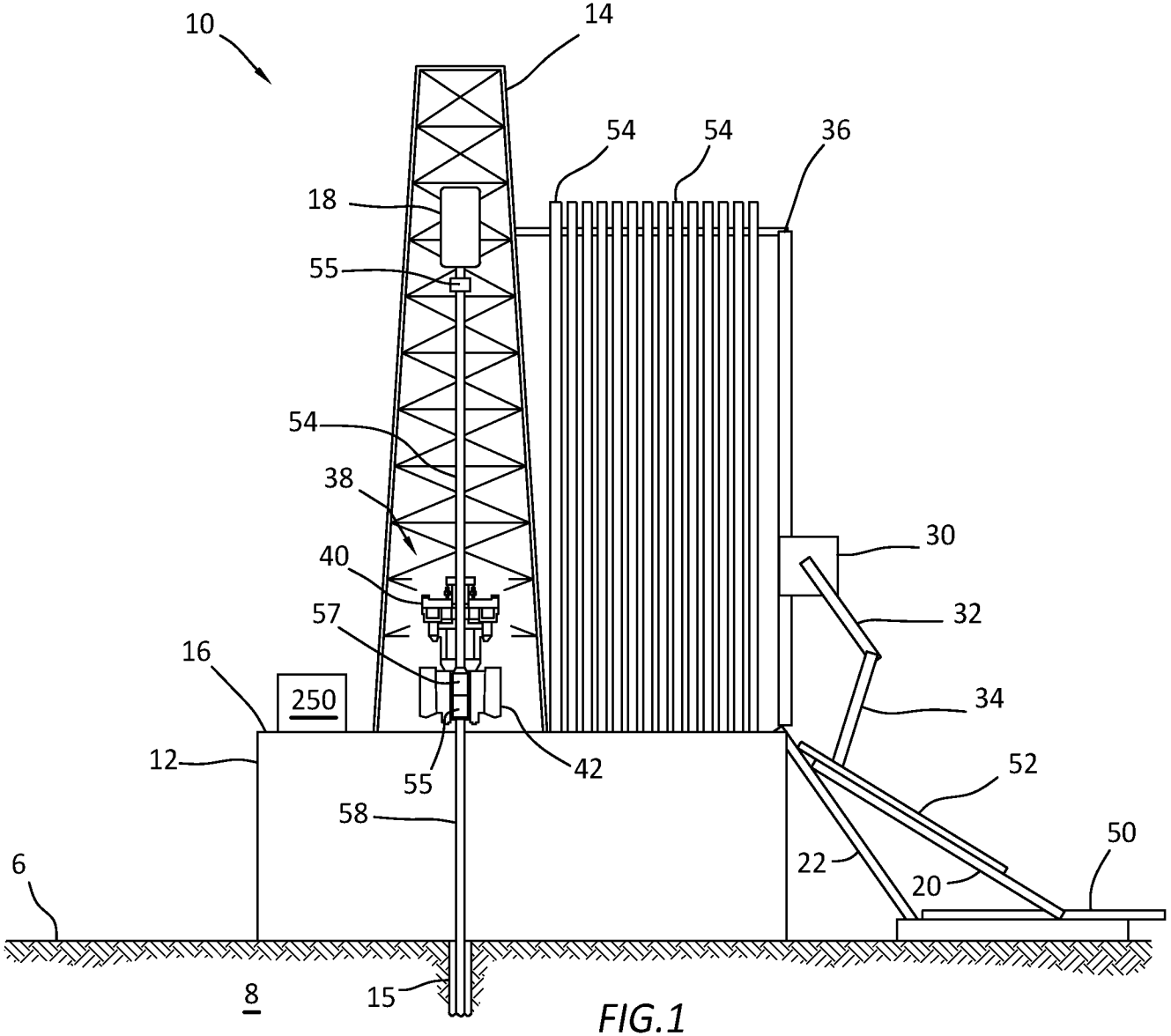
FIG. 1 is a representative simplified front view of a rig being utilized for a subterranean operation, in accordance with certain embodiments.

As used herein, "tubular" refers to an elongated cylindrical tube and can include any of the tubulars manipulated around a rig, such as tubular segments, tubular stands, tubulars, and tubular string, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing," "casing segment," "casing string," or "drill collar."

FIG. 1 is a representative simplified front view of a rig being utilized for a subterranean operation (e.g., tripping in or out a tubular string to or from a wellbore), in accordance with certain embodiments. The rig 10 can include a platform 12 with a rig floor 16 and a derrick 14 extending up from the rig floor 16. The derrick 14 can provide support for hoisting the top drive 18 as needed to manipulate tubulars. A catwalk 20 and V-door ramp 22 can be used to transfer horizontally stored tubular segments 50 to the rig floor 16. A tubular segment 52 can be one of the horizontally stored tubular segments 50 that is being transferred to the rig floor 16 via the catwalk 20. A pipe handler 30 with articulating arms 32, 34 can be used to grab the tubular segment 52 from the catwalk 20 and transfer the tubular segment 52 to the top drive 18, the fingerboard 40, the wellbore 15, etc. However, it is not required that a pipe handler 30 be used on the rig 10. The top drive 18 can transfer tubulars directly between the catwalk 20 and a well center on the rig floor (e.g., using an elevator coupled to the top drive).

The tubular string 58 can extend into the wellbore 15, with the wellbore 15 extending through the surface 6 into the subterranean formation 8. When tripping the tubular string 58 into the wellbore 15, tubulars 54 are sequentially added to the tubular string 58 to extend the length of the tubular string 58 into the earthen formation 8. FIG. 1 shows a land-based rig. However, it should be understood that the principles of this disclosure are equally applicable to off-shore rigs where "off-shore" refers to a rig with water between the rig floor and the earth surface 6. When tripping the tubular string 58 out of the wellbore 15, tubulars 54 are sequentially removed from the tubular string 58 to reduce the length of the tubular string 58 in the wellbore 15.

When tripping the tubular string 58 into the wellbore 15, the pipe handler 30 can be used to deliver the tubulars 54 to a well center on the rig floor 16 in a vertical orientation and hand the tubulars 54 off to an iron roughneck 38 or a top drive 18. When tripping the tubular string 58 out of the wellbore 15, the pipe handler 30 can be used to remove the tubulars 54 from the well center in a vertical orientation or receive the tubulars 54 from the iron roughneck 38 or a top drive 18. The iron roughneck 38 can make a threaded connection between a tubular 54 being added and the tubular string 58. A spinner assembly 40 can engage a body of the tubular 54 to spin a pin end 57 of the tubular 54 into a threaded box end 55 of the tubular string 58, thereby threading the tubular 54 into the tubular string 58. The torque wrench assembly 42 can provide a desired torque to the threaded connection, thereby completing the connection. This process can be reversed when the tubulars 54 are being removed from the tubular string 58.

A rig controller 250 can be used to control the rig 10 operations, including controlling various rig equipment, such as the pipe handler 30, the top drive 18, and the iron roughneck 38. The rig controller 250 can control the rig equipment autonomously (e.g., without periodic operator interaction,), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation). A portion of the rig controller 250 can also be distributed around the rig 10, such as having a portion of the rig controller 250 in the pipe handler 30, in the iron roughneck 38, or otherwise distributed around the rig 10.

Figure 2:
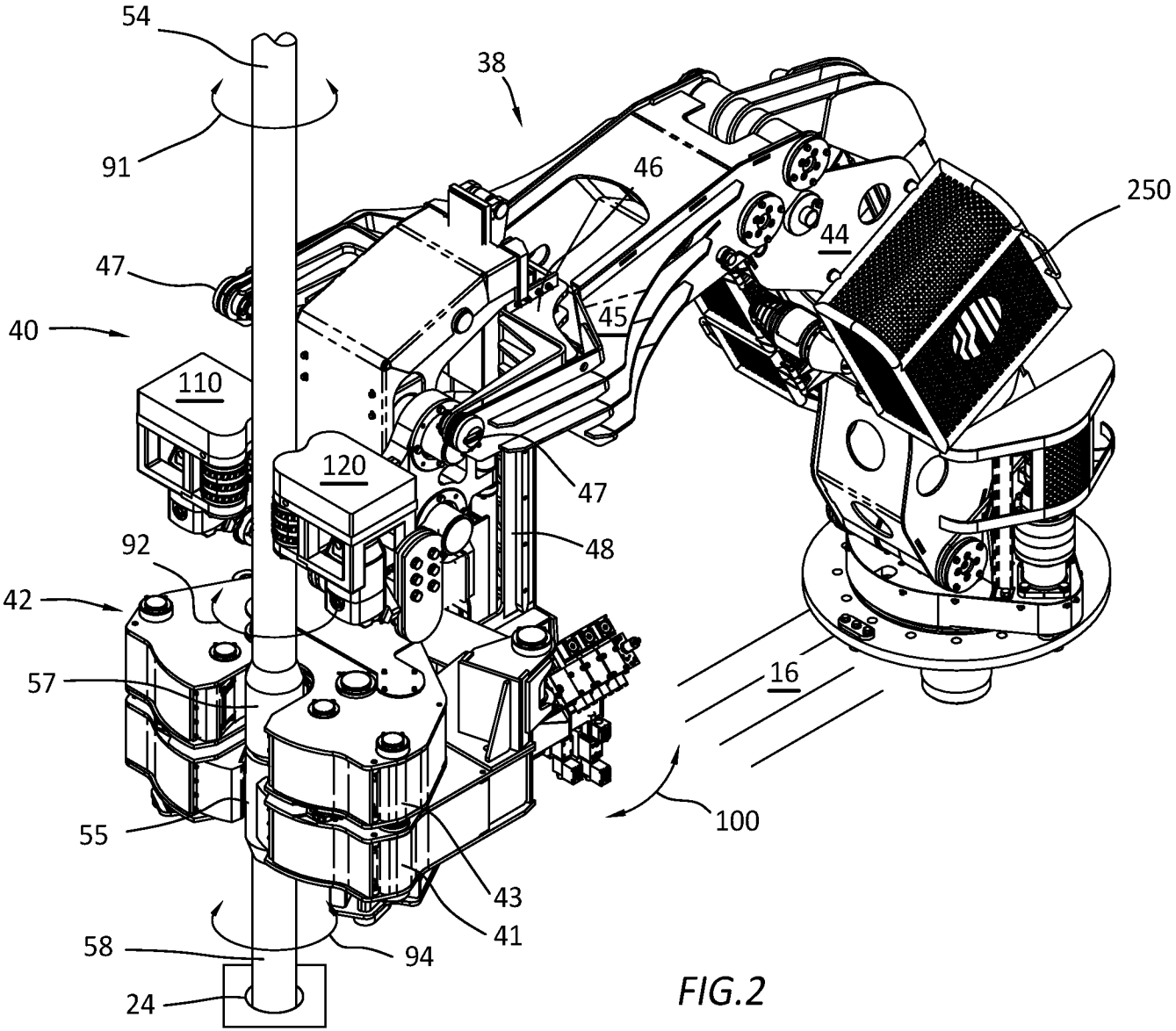
FIG. 2 is a representative perspective view of an iron roughneck on a rig floor, in accordance with certain embodiments.

FIG. 2 is a representative perspective view of an iron roughneck 38 with a spinner assembly 40 on a rig floor 16 with a body of the tubular 54 engaged with the spinner assembly 40 and the torque wrench assembly 42 positioned to grip both the box end 55 of the tubular string 58 and the pin end 57 of the tubular 54. The iron roughneck 38 can include a robot arm 44 that supports the iron roughneck 38 from the rig floor 16. The robotic arm 44 can include a support arm 45 that can couple to a frame 48 via a frame arm 46. The support arm 45 can support and lift the frame 48 of the iron roughneck 38 via the frame arm 46, which can be rotationally coupled to the support arm 45 via the pivots 47. The frame 48 can provide structural support for the spinner assembly 40 and the torque wrench assembly 42. The robotic arm 44 can move the frame 48 from a retracted position (i.e., away from the well center 24) to an extended position (i.e., toward the well center 24) and back again as needed to provide support for making or breaking connections in the tubular string 58. In the extended position of the frame 48, the spinner assembly 40 and the torque wrench assembly 42 can engage the tubular 54 and the tubular string 58, as desired.

The top drive 18 (not shown) can rotate the tubular string 58 in either clockwise or counterclockwise directions as shown by arrows 94. The tubular string 58 is generally rotated in a direction that is opposite the direction used to unthread tubular string 58 connections. When a connection is to be made or broken, a first wrench assembly (or backup tong) 41 of the torque wrench assembly 42 can grip the box end 55 of the tubular string 58. The first wrench assembly 41 can prevent further rotation of the tubular string 58 by preventing rotation of the box end 55 of the tubular string 58.

If a connection is being made, the spinner assembly 40 can engage the tubular 54 at a body portion, which is the portion of the tubular between the pin end 57 and box end 55 of the tubular 54. With the pin end 57 of the tubular 54 engaged with the box end 55 of the tubular string 58, the spinner assembly 40 can rotate the tubular 54 in a direction (arrows 91) to thread the pin end 57 of the tubular 54 into the box end 55 of the tubular string 58, thereby forming a connection of the tubular 54 to the tubular string 58. When a predetermined torque of the connection is reached by the spinner assembly 40 rotating the tubular 54 (arrows 91), then a second wrench assembly (or torque wrench) 43 of the torque wrench assembly 42 can grip the pin end 57 of the tubular 54 and rotate the pin end 57. By rotating the second wrench assembly 43 relative to the first wrench assembly 41 (arrows 92), the torque wrench assembly 42 can torque the connection to a desired torque, thereby completing the connection of the tubular 54 to the tubular string 58. The iron roughneck can then be retracted from the well center 24, and the subterranean operation can continue.

If a connection is being broken, the spinner assembly 40 can engage the tubular 54 at the body portion. The first wrench assembly 41 can grip the box end 55 of the tubular string 58, and the second wrench assembly 43 can grip the pin end 57 of the tubular 54. By rotating the pin end 57 of the tubular 54 relative to the box end 55 of the tubular string 58, the previously torqued connection can be broken loose. After the connection is broken, the spinner assembly 40 can rotate the tubular 54 relative to the tubular string 58 (arrows 91), thereby releasing the tubular 54 from the tubular string 58. The tubular 54 can then be removed from the well center by the top drive or pipe handler (or other means), and the iron roughneck retracted from the well center 24 to allow the top drive access to the top end of the tubular string 58.

The position of the spinner assembly 40 and wrench assembly 42 relative to the rig floor 16 (and thus the tubular string 58) can be controlled by the controller 250 via the robotic arm 44 and the frame arm 46, which is moveable relative to the frame 48. The controller 250 or other controllers, via the robotic arm 44, can manipulate the frame 48 by lifting, lowering, extending, retracting, rotating the arm, etc. The robotic arm 44 can be coupled to the frame 48 via the support arm 45, which can be rotatably coupled to the frame arm 46 via pivots 47. The frame 48 can move up and down relative to the frame arm 46 to raise and lower the spinner assembly 40 and wrench assembly 42 as needed to position the assemblies 40, 42 relative to the tubular string 58. The frame 48 can also tilt (arrows 100) via pivots 47 to longitudinally align a center axis of the assemblies 40, 42 relative to the tubular string 58.

Figure 3A:
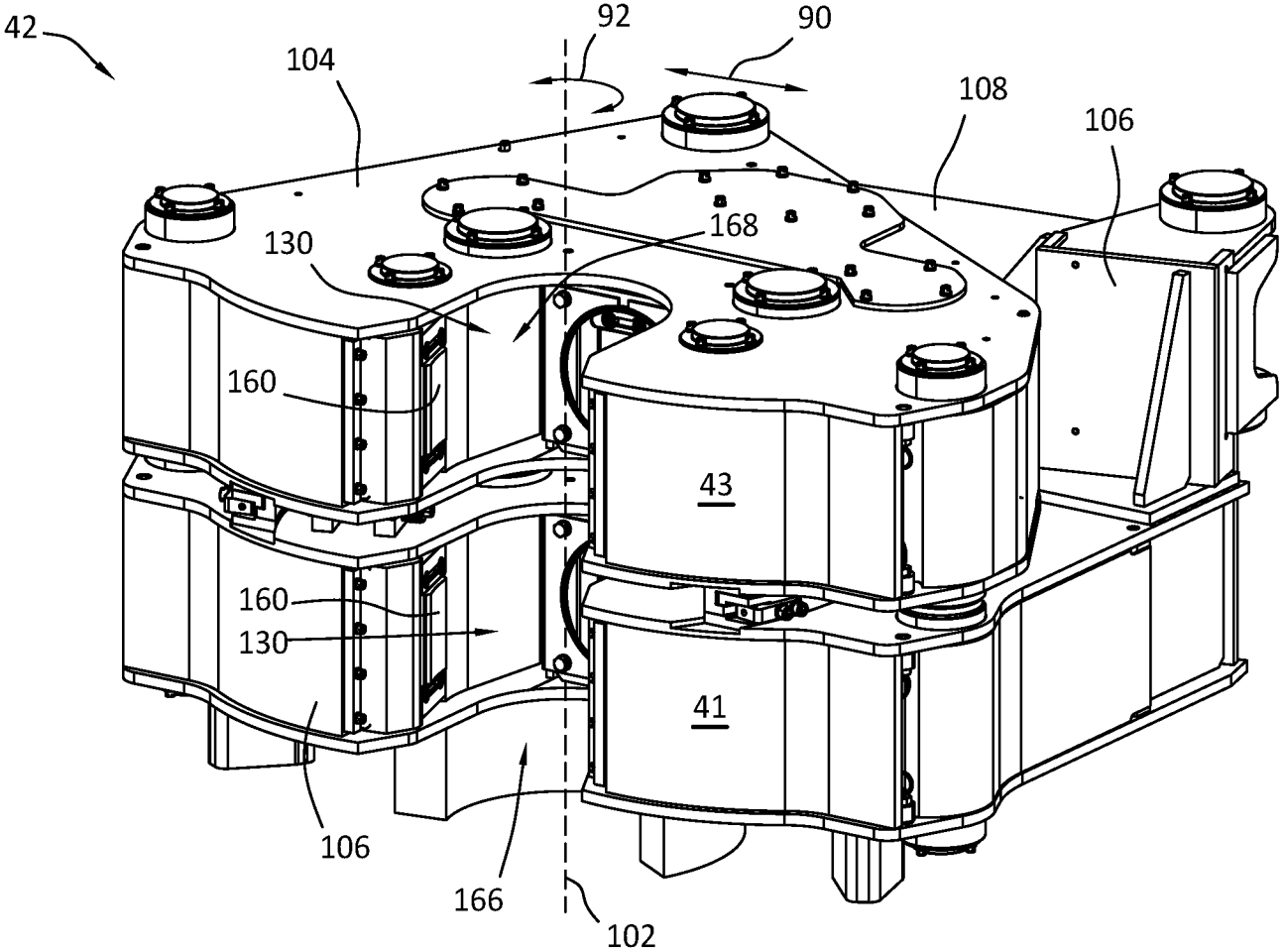
FIG. 3A is a representative perspective view of a wrench assembly of the iron roughneck of FIG. 2, in accordance with certain embodiments.

FIG. 3A is a representative perspective view of a wrench assembly 42 of the iron roughneck 38. The wrench assembly 42 can include a torque wrench 43 and a backup tong 41 for making or breaking joints in a tubular string 58. The torque wrench 43 can include a wrench 130 assembled within a body 104, where the body 104 provides structural support for the wrench 130 components of the torque wrench 43. The body 104 can be rotationally attached to a chassis 106 and coupled to each other through a torque actuator 108, where extending or contracting the torque actuator 108 (arrows 90) can rotate (arrows 92) the body 104 (and thus the torque wrench 43) relative to the chassis 106 about the axis 102. The chassis 106 provides structural support for the wrench 130 components of the backup tong 41. An opening 168 in the torque wrench 43 aligns with an opening 166 in the backup tong 41, such that the center of each opening 166, 168 is in line with the central axis 102 of the wrench assembly 42, with the torque wrench 43 being positioned above the backup tong 41. The wrench 130 of the torque wrench 43 is similar if not the same as the wrench 130 of the backup tong 41. Both wrenches 130 can extend a plurality of grippers 160 into engagement of a tubular that has been received in the openings 166, 168.

Figure 3B:
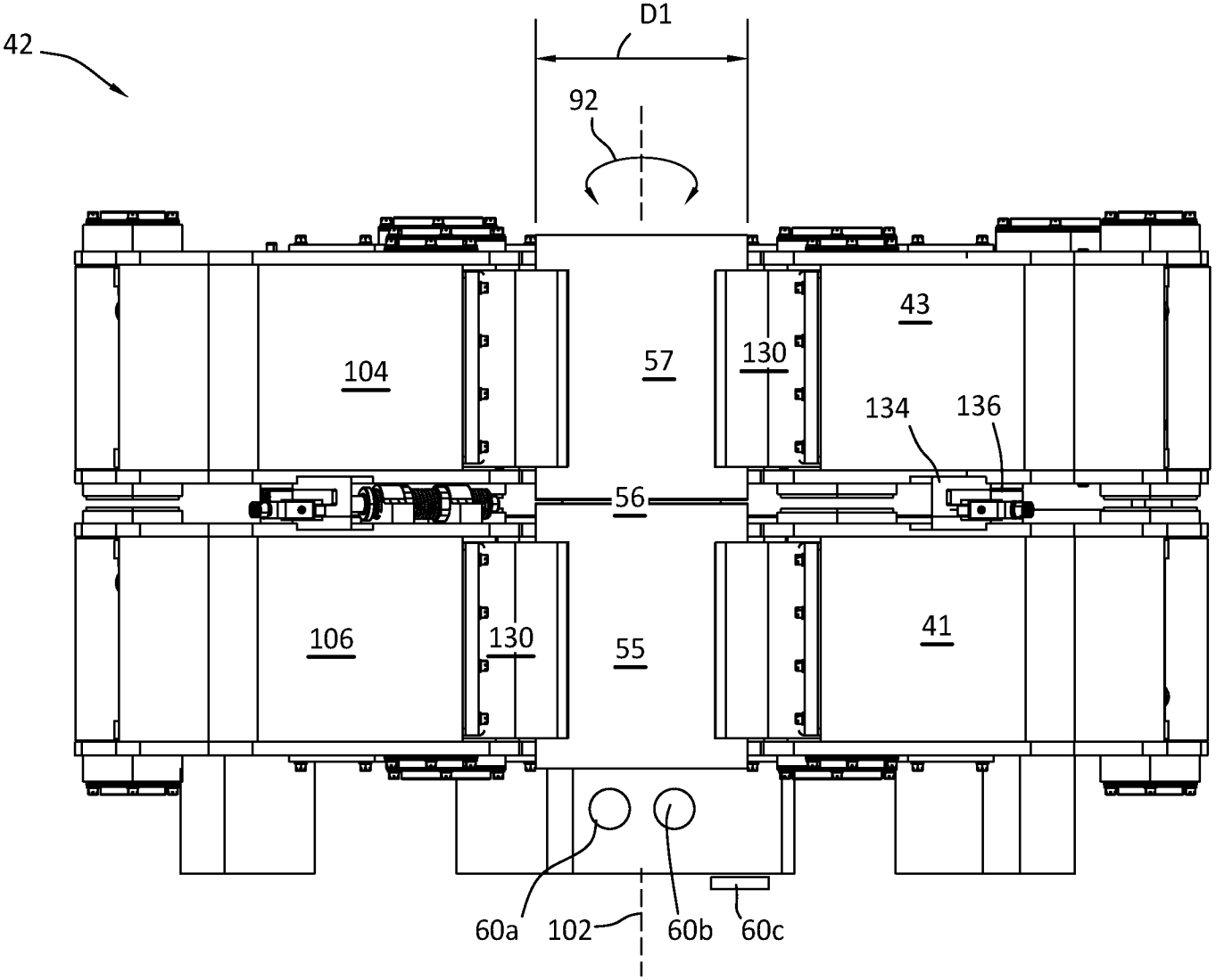
FIG. 3B is a representative front view of a wrench assembly of the iron roughneck of FIG. 2 with a tubular joint engaged with the wrench assembly, in accordance with certain embodiments.

FIG. 3B is a representative front view of a wrench assembly 42 of the iron roughneck 38 with a tubular joint 56 (including pin end 57 threaded into box end 55) engaged with the wrench assembly 42. A tubular joint 56 has been received in the openings 166, 168 of the torque wrench 43 and the backup tong 41, respectively. The plurality of grippers 160 of the torque wrench 43 have been engaged with the pin end 57 of the joint 56, and the plurality of grippers 160 of the backup tong 41 have been engaged with the box end 55 of the joint 56. The body 104 of the torque wrench 43 (including a wrench 130) has been slightly rotated (arrows 92) about the axis 102 relative to the chassis 106 and the backup tong 41 (including a wrench 130).

The torque wrench 43 can include a circular guide 134 mounted to a bottom of the body 104 of the torque wrench 43. The circular guide 134 interlocks with a circular channel 136 and is slidingly coupled to the circular channel 136. The circular channel 136 is mounted to the top of the backup tong 41 portion of the chassis 106. As the body 104 is rotated relative to the body 106, the circular guide 134 slides along the circular channel 136, causing the body 104 to rotate about the axis 102.

The wrench assembly 42 can support tubulars with an outer diameter D1. The outer diameter D1 can range from 11 inches down to 2 inches, but not limited to this diameter range. The wrench assembly of the current disclosure can deliver up to 120K ft-lb (162.7 Kn-m) torquing force to a tubular joint to make or break the joint connection. The gripping force for each gripper can be up to 60K pounds.

Figure 3C:
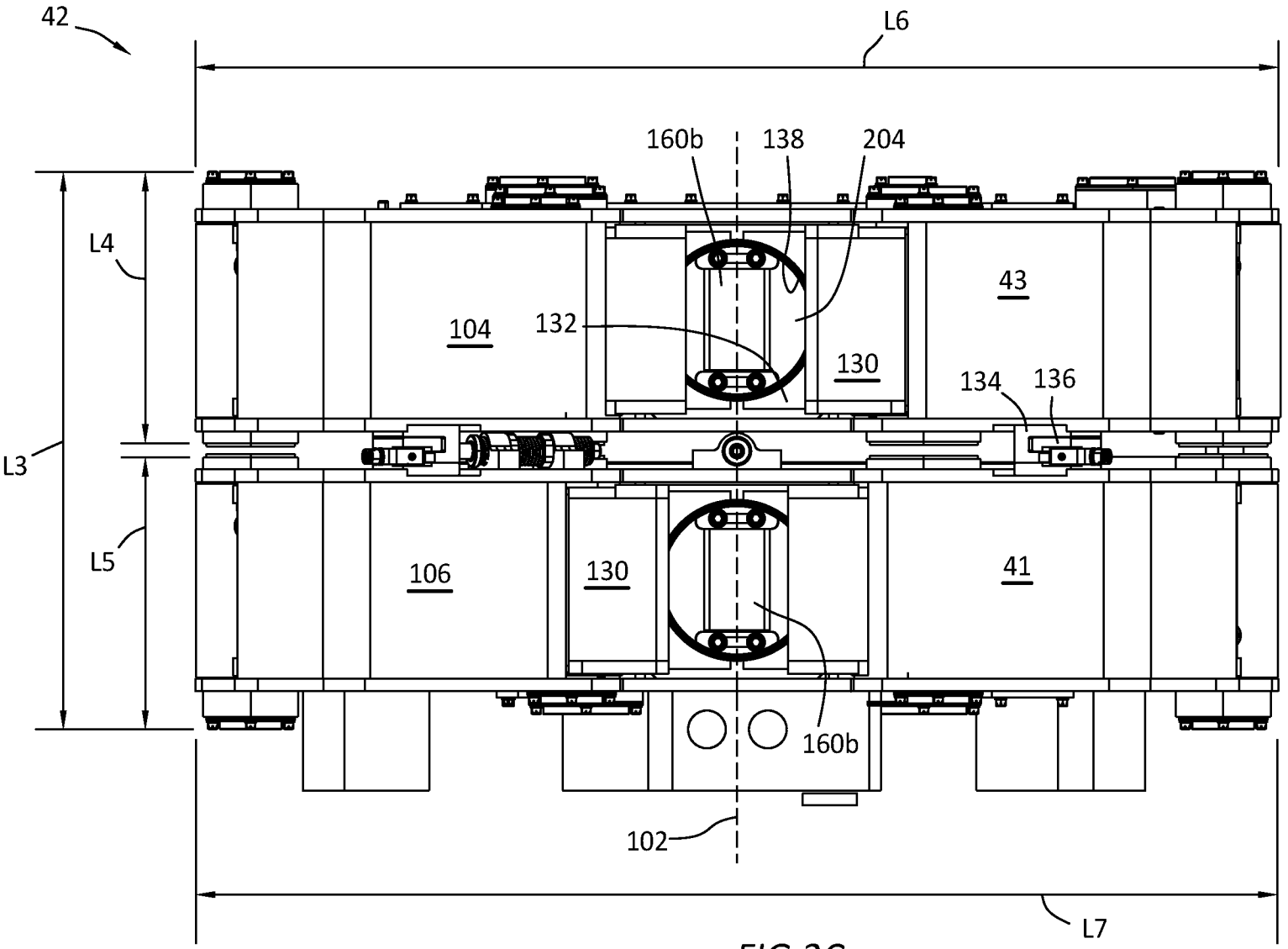
FIG. 3C is a representative front view of a wrench assembly of the iron roughneck of FIG. 2 without a tubular joint engaged with the wrench assembly, in accordance with certain embodiments.

FIG. 3C is a representative front view of a wrench assembly 42 of the iron roughneck 38 with the tubular joint 56 removed for clarity. The body 104 is still slightly rotated relative to the chassis 106 via the torque actuator 108 (not shown, see FIG. 3A), the circular guide 134, and the circular channel 136. A rear (or center) gripper 160*b* can be seen at the back of each of the openings 166, 168. The gripper 160*b* can be mounted to an end of a piston 204 with a cylindrical body. The piston 204 can be slidably coupled to a bore 138 formed in a support 132, where the piston 204 extends and retracts within the bore 138 into and out of engagement with a tubular joint 56, respectively. The body 104 can have a width L6 with a height L4. The chassis 106 can have a width L7 with a height L5. The overall height of the torque wrench assembly 42 can be a height L3.

The width L6 of the body 104 can be less than 47 inches, less than 46 inches, less than 45 inches, less than 44 inches, or less than 43 inches. The width L7 of the chassis 106 can be less than 47 inches, less than 46 inches, less than 45 inches, less than 44 inches, or less than 43 inches. The depth L8 of the chassis 106 (see FIG. 7) can be less than 40 inches, less than 39 inches, less than 38 inches, less than 37 inches, less than 36 inches, or less than 35.5 inches. The height L4 of the body 104 can be less than 14 inches, less than 13 inches, less than 12 inches, or less than 11 inches. The height L5 of the backup tong 41 portion of the chassis 106 can be less than 14 inches, less than 13 inches, less than 12 inches, or less than 11 inches. The height L3 of the wrench assembly 42 can be less than 25 inches, less than 24 inches, less than 23 inches, or less than 22 inches.

Figure 4:
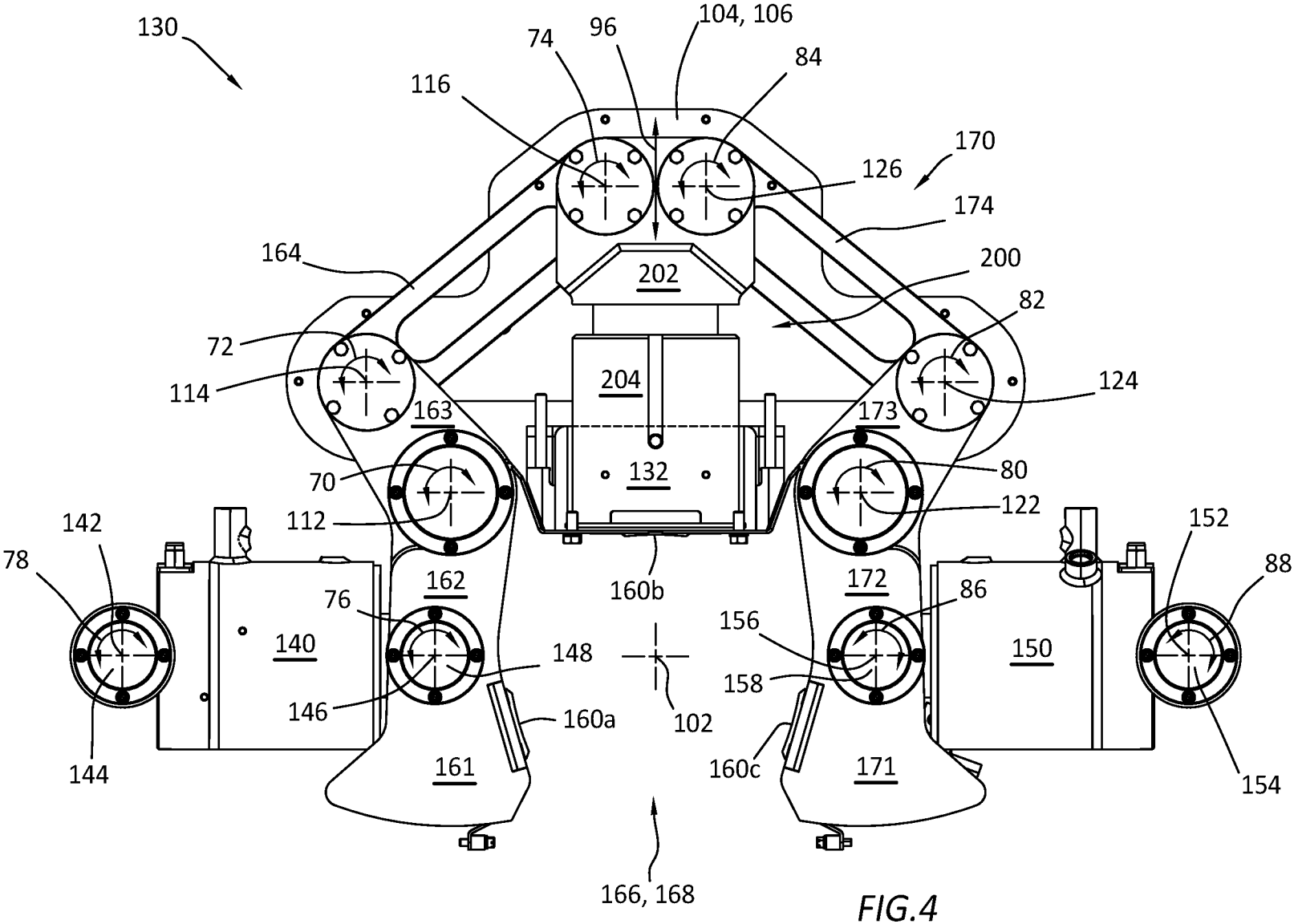
FIG. 4 is a representative perspective top view of a wrench of the wrench assembly in an unengaged configuration, in accordance with certain embodiments.

FIG. 4 is a representative perspective top view of a wrench 130 (or gripping mechanism) of the wrench assembly 42 in an unengaged configuration. It is preferred to use the wrench 130 in both the torque wrench 43 and the backup tong 41. Therefore, the discussion regarding the wrench 130 is generally applicable to both the torque wrench 43 and the backup tong 41 of the current disclosure unless described otherwise. So, when the body 104 of the torque wrench 43 is mentioned, it should be understood that the discussion generally applies to the chassis 106 of the backup tong 41 as well. Additionally, when the opening 166 of the torque wrench 43 is mentioned, it should be understood that the discussion generally applies to the opening 168 of the backup tong 41 as well.

The wrench 130 can include a linkage mechanism 170 various components that at least partially surround the opening 166 or 168 of the respective torque wrench 43 or the backup tong 41. The linkage mechanism 170 can include left and right pivot arms 162, 172, left and right links 164, 174, and a piston assembly 200. As used herein, orientation terms such as "left," "right," "up," "down," "lower," "upper," "top," "bottom," "clockwise," or "counterclockwise" generally indicate a relative position or movement of object(s) based on the orientation of the objects in the figure.

The left pivot arm 162 can be rotationally attached to the body 104 at pivot axis 112 and can rotate (arrows 70) about the pivot axis 112 relative to the body 104. An end 161 of the pivot arm 162 can include a gripper 160*a* removably attached to a surface that faces the opening 166. An opposite end 163 can be rotationally attached at a pivot axis 114 to an end of a link 164. The link 164 can rotate (arrows 72) relative to the end 163 about the pivot axis 114. An opposite end of the link 164 can be attached at a pivot axis 116 to a coupling 202 of the piston assembly 200. The link 164 can rotate (arrows 74) relative to the coupling 202, with the coupling 202 being constrained to prevent rotation relative to the body 104. Therefore, the link 164 can rotate relative to the body 104, while the coupling 202 moves toward or away from the opening 166 without rotating relative to the body 104.

The right pivot arm 172 can be rotationally attached to the body 104 at pivot axis 122 and can rotate (arrows 80) about the pivot axis 122 relative to the body 104. An end 171 of the pivot arm 172 can include a gripper 160*c* removably attached to a surface that faces the opening 166. An opposite end 173 can be rotationally attached at a pivot axis 124 to an end of a link 174. The link 174 can rotate (arrows 82) relative to the end 173 about the pivot axis 124. An opposite end of the link 174 can be attached at a pivot axis 126 to a coupling 202 of the piston assembly 200. The link 174 can rotate (arrows 84) relative to the coupling 202, with the coupling 202 being constrained to prevent rotation relative to the body 104. Therefore, the link 174 can rotate relative to the body 104, while the coupling 202 moves toward or away from the opening 166 without rotating relative to the body 104.

An end 144 of a left actuator 140 can be rotationally attached at a pivot axis 142 to the body 104. An opposite end 148 of the left actuator 140 can be rotationally attached at a pivot axis 146 to the left pivot arm 162 between the pivot axis 112 and the gripper 160*a*. As the end 148 of the left actuator 140 extends from the end 144, the left pivot arm 162 is rotated counterclockwise about the pivot axis 112, moving the gripper 160*a* toward a center axis 102. As the end 148 of the left actuator 140 retracts toward the end 144, the left pivot arm 162 is rotated clockwise about the pivot axis 112, moving the gripper 160*a* away from a center axis 102.

An end 154 of a right actuator 150 can be rotationally attached at a pivot axis 152 to the body 104. An opposite end 158 of the right actuator 150 can be rotationally attached at a pivot axis 156 to the right pivot arm 172 between the pivot axis 122 and the gripper 160*c*. As the end 158 of the right actuator 150 extends from the end 154, the right pivot arm 172 is rotated clockwise about the pivot axis 122, moving the gripper 160*c* toward a center axis 102. As the end 158 of the right actuator 150 retracts toward the end 154, the right pivot arm 172 is rotated counterclockwise about the pivot axis 122, moving the gripper 160*c* away from a center axis 102.

Figure 5:
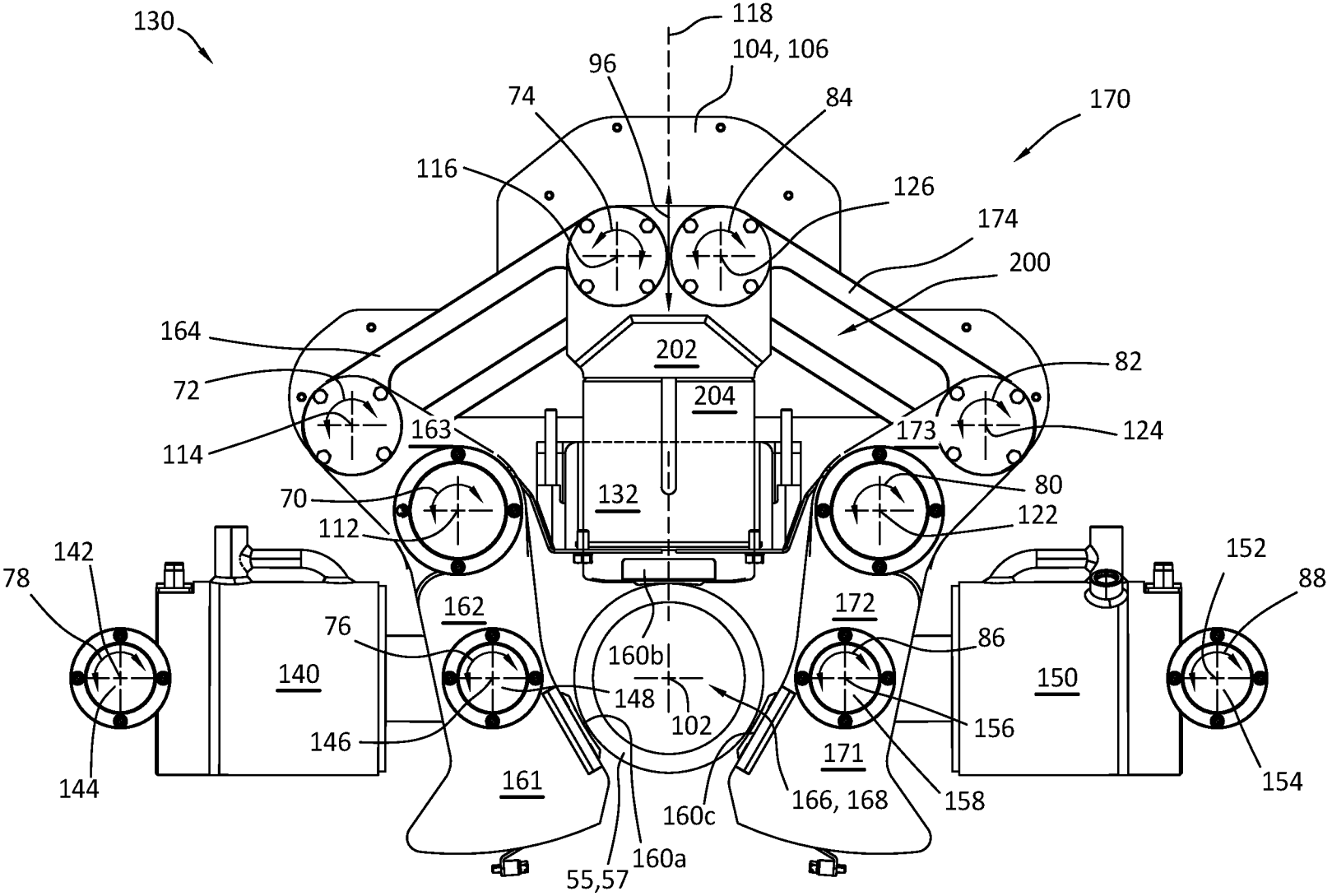
FIG. 5 is a representative perspective top view of a wrench of the wrench assembly in an engaged configuration with a tubular, in accordance with certain embodiments.

FIG. 5 is a representative perspective top view of a wrench 130 (or gripping mechanism) of the wrench assembly 42 in an engaged configuration with a tubular, in accordance with certain embodiments. The left and right actuators 140, 150 are actuated simultaneously to extend or retract the respective end 148, 158.

When extending the end 148 toward the center axis 102, the left pivot arm 162 is rotated in a counterclockwise direction around the pivot axis 112, thereby rotating the end 163 counterclockwise about the pivot axis 112 and pulling the link 164 down, which acts to pull the coupling 202 down, via the rotational coupling at the pivot axis 116.

When extending the end 158 toward the center axis 102, the right pivot arm 172 is rotated in a clockwise direction around the pivot axis 122, thereby rotating the end 173 clockwise about the pivot axis 122 and pulling the link 174 down, which acts to pull the coupling 202 down, as well, via the rotational coupling at the pivot axis 126.

The links 164, 174 act on the coupling 202 in opposing X-directions but in the same Y-direction. Therefore, the X-direction (right or left) components of the movement from each link 164, 174 on the coupling 202 are canceled, and the Y-direction (down) component of the movement from each link 164, 174 is commensurate with the downward movement of the pivot axes 116, 126. As the left pivot arm 162 rotates counterclockwise and the right pivot arm 172 rotates clockwise, the links 164, 174 act to pull the coupling 202 down toward the center axis 102 (arrows 96). As the coupling 202 moves downward, it closes a gap (of length L1) between the coupling 202 and the piston 204. When the gap L1 is closed, the coupling 202 then forces the piston 204 toward the center axis 102. The piston 204 extends from the support 132 into engagement with a tubular pin end 57 or box end 55. The piston 204 can have a longitudinal center axis 118, which can also be aligned with a center axis of a bore 138 in the support 132. The piston assembly will be discussed in more detail below.

The left and right actuators 140, 150 can continue extending the respective ends 148, 158 until the grippers 160*a*, 160*b*, 160*c* engage a tubular joint (e.g., the pin end 57 or box end 55). The linkage mechanism 170 distributes the force from the actuators 140, 150 substantially equally between the grippers 160*a*, 160*b*, 160*c*, providing substantially uniform gripping engagement force for each of the grippers 160*a*, 160*b*, 160*c*. The grippers 160*a*, 160*b*, 160*c* can remain engaged with the tubular joint as the wrench is held in place (e.g., the backup tong 41) or rotated (e.g., the torque wrench 43) to torque or untorque a tubular joint 56.

Figure 6:
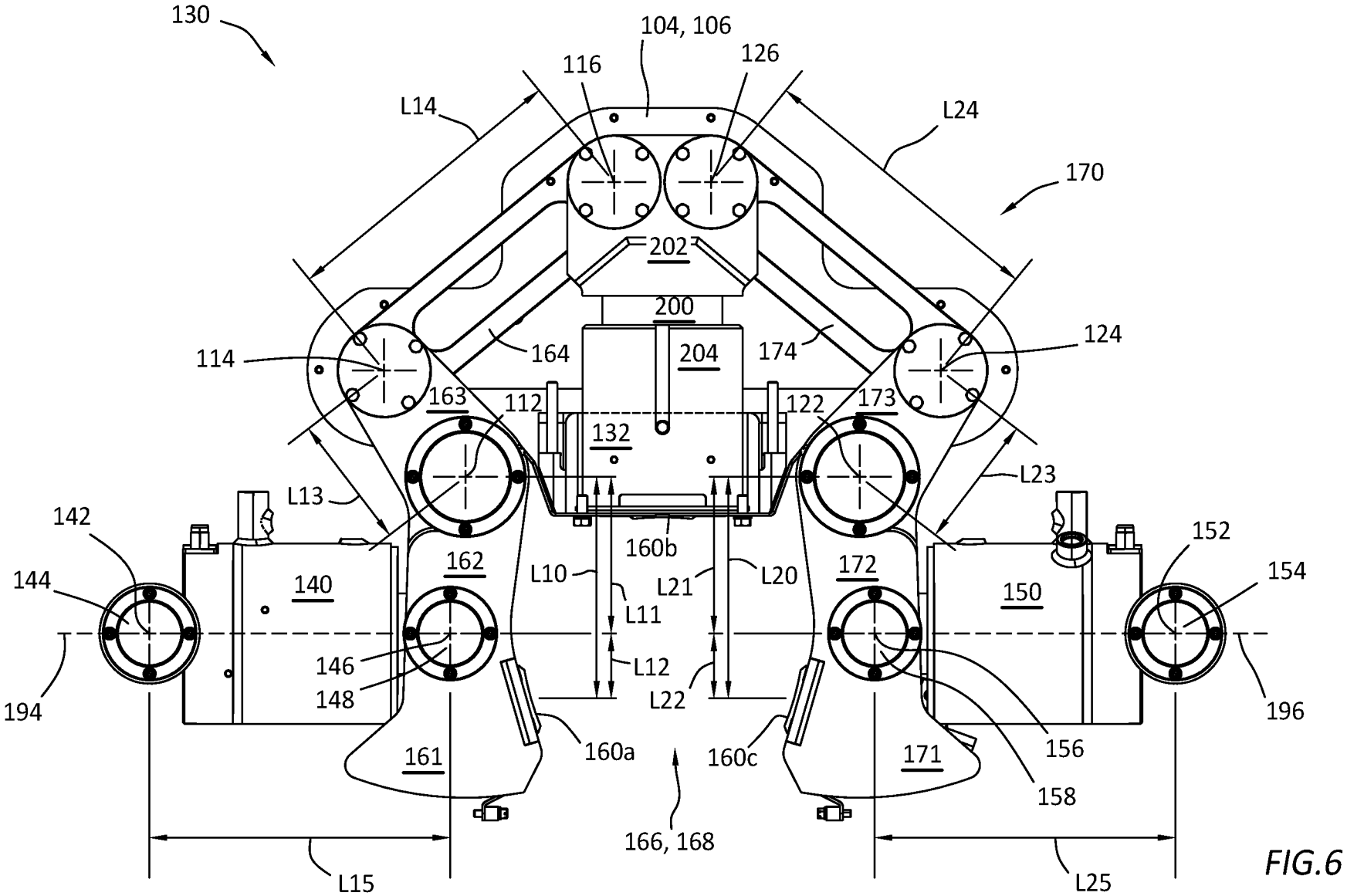
FIG. 6 is another representative perspective top view of a wrench of the wrench assembly in an unengaged configuration, in accordance with certain embodiments.

FIG. 6 is a representative perspective top view of a wrench 130 and of the wrench assembly 42 in an unengaged configuration. FIG. 6 illustrates the relative distances between various pivot axes or between a pivot axis and a gripper 160 (e.g., 160*a*, 160*c*).

The distance L10 is the distance between the pivot axis 112 and a center of the gripper 160*a*. The distance L11 is the distance between the pivot axis 112 and the pivot axis 146. The distance L12 is the distance between the pivot axis 146 and the center of the gripper 160*a*. The distance L13 is the distance between the pivot axis 112 and the pivot axis 114. The distance L14 is the distance between the pivot axis 114 and the pivot axis 116. The distance L15 is the distance between the pivot axis 142 and the pivot axis 146.

The distance L20 is the distance between the pivot axis 122 and a center of the gripper 160*c*. The distance L21 is the distance between the pivot axis 122 and the pivot axis 156. The distance L22 is the distance between the pivot axis 156 and the center of the gripper 160*c*. The distance L23 is the distance between the pivot axis 122 and the pivot axis 124. The distance L24 is the distance between the pivot axis 124 and the pivot axis 126. The distance L25 is the distance between the pivot axis 152 and the pivot axis 156.

In operation, when the left actuator 140 extends the end 148 and rotates the left pivot arm 162 about the pivot axis 112, the distance L11 is larger than the distance L13, which acts as a force multiplier, such that the force applied to the pivot axis 146 is increased by the shorter end 163 that acts on the link 164. Also, by positioning the pivot axis 146 between the pivot axis 112 and the gripper 160*a*, the distance traveled by the gripper 160*a* is greater than the distance traveled by the end 148 of the left actuator 140. This reduces the size of the left actuator 140 since the actuator arm that drives the end 148 can be shorter while still being able to move the gripper 160*a* a desired distance to accommodate the largest and smallest diameter tubular joints.

When the right actuator 150 extends the end 158 and rotates the right pivot arm 172 about the pivot axis 122, the distance L21 is larger than the distance L23, which acts as a force multiplier, such that the force applied to the pivot axis 156 is increased by the shorter end 173 that acts on the link 174. Also, by positioning the pivot axis 156 between the pivot axis 122 and the gripper 160*c*, the distance traveled by the gripper 160*c* is greater than the distance traveled by the end 158 of the right actuator 150. This reduces the size of the right actuator 150 since the actuator arm that drives the end 158 can be shorter while still being able to move the gripper 160*c* a desired distance to accommodate the largest and smallest diameter tubular joints.

The smaller actuators 140, 150 contribute to the reduced overall size of the wrench 130 (and thereby a reduced overall size of the wrench assembly 42). The left actuator 140 extends the end 148 in an opposite direction compared to the extension of the end 158 by the right actuator 150. A longitudinal axis 196 of the left actuator 140 can be substantially parallel to the longitudinal axis 198 of the right actuator 150, such that the actuator 140 extends the end 148 toward the actuator 150 along the axis 196 and the actuator 150 extends the end 158 toward the actuator 140 along the axis 198.

Figure 7:
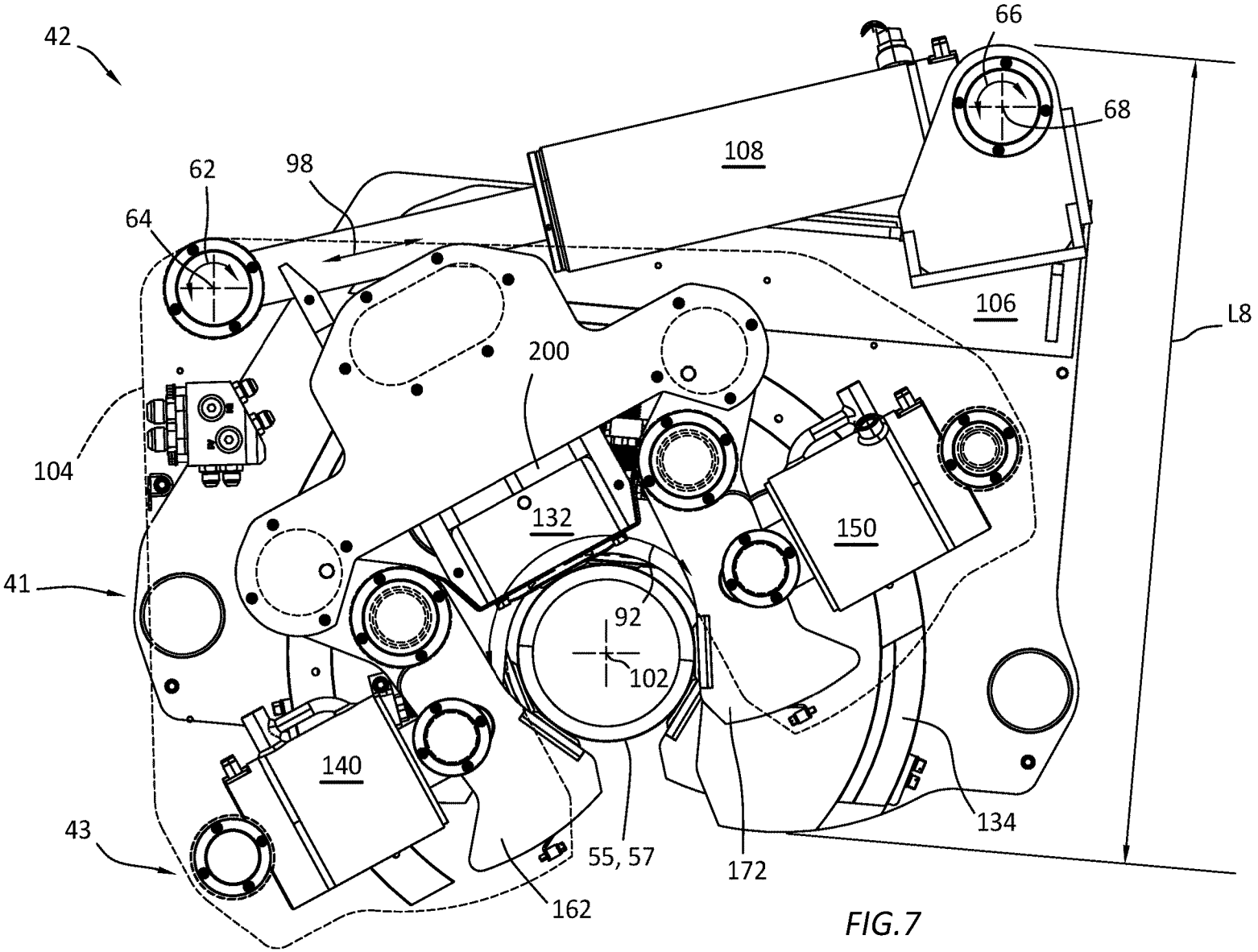
FIG. 7 is a representative top view of a wrench assembly in an engaged configuration with a tubular joint, in accordance with certain embodiments.

FIG. 7 is a representative top view of a wrench assembly 42 in an engaged configuration with a pin end 57 and a box end 55 of a tubular joint 56. The torque wrench 43 is rotated relative to the backup tong 41. The torque actuator 108 can be rotationally connected to the chassis 106 at the pivot axis 68 and to the body 104 at the pivot axis 64. When the torque actuator 108 is extended or retracted, one end of the actuator 108 can rotate (arrows 68) about the pivot axis 66, while the other end of the actuator 108 can rotate (arrows 62) about the pivot axis 64. As the torque actuator 108 extends, the body 104 rotates (arrows 92) about the center axis 102 in a counterclockwise direction along the circular guide 134. As the torque actuator 108 retracts, the body 104 rotates (arrows 92) about the center axis 102 in a clockwise direction along the circular guide 134. The depth L8 is an overall depth of the wrench assembly 42. The depth L8 along with the width L7 (FIG. 3C) and the height L3 (FIG. 3C) defines the overall volume of the wrench assembly 42.

Figure 8:
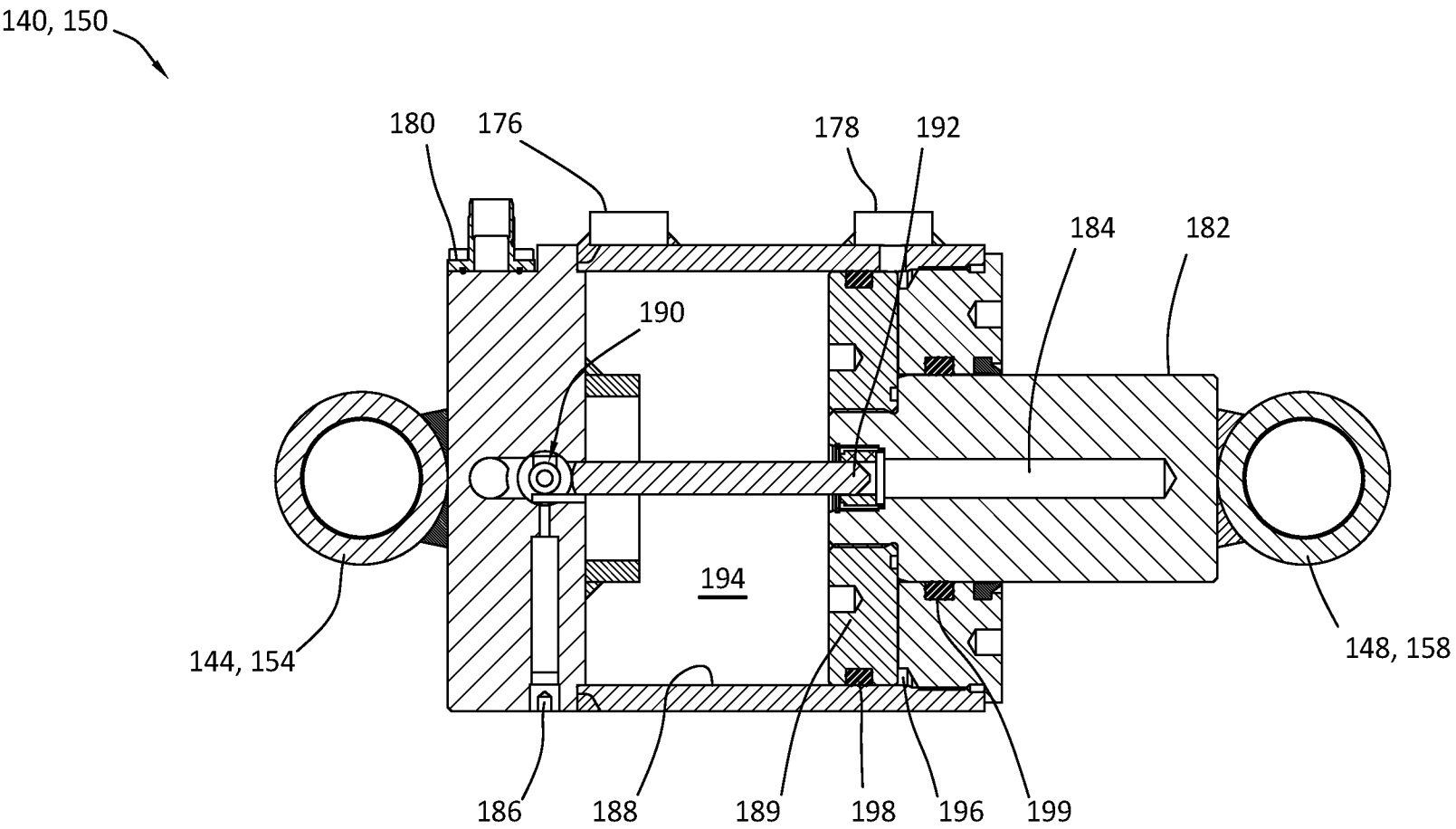
FIG. 8 is a representative partial cross-sectional view of a linkage actuator, in accordance with certain embodiments.

FIG. 8 is a representative partial cross-sectional view of a linkage actuator 140, 150, in accordance with certain embodiments. The end 144, 154 can be rigidly attached to a body 180 of the actuator 140, 150. The opposite end 148, 158 can be rigidly attached to an end of a piston rod 182 that is extendable from the body 180. The opposite end of the piston rod 182 can include a cylindrical disk 189 that is slidably and sealingly coupled to a bore 184 in the body 180. The seal 198 can be used to seal the disk 189 to the bore 188. Fluid inlets 176, 178 can be used to drive the cylindrical disk 189 along the bore 188 in the body 180 to extend or retract the piston rod 182 as is well known in the art of pistons. The annular space 196 provides a volume for the inlet 178 to inject fluid into the actuator to retract the piston. Injecting fluid into the cavity 194 can extend the piston rod 182. The seal 199 can slidingly and sealingly engage the piston rod 182 with the body 180.

The actuator 140, 150 can include a Linear Variable Differential Transformer (LVDT) sensor. The LVDT sensor can detect and report the position of the piston rod 182 relative to the body 180. A controller (e.g., controller 250) can use the relative position of the piston rod 182 to determine the position of the grippers 160*a*, 160*c* as well as the gripper 160*b*, thereby providing real-time verification of the position of the grippers 160*a*, 160*b*, 160*c*. This can be used to verify the diameter of the tubular joint 56, and detect failures of the wrench 130 by detecting measured diameter readings that are different than the known diameter of the tubular joint being engaged by the grippers 160*a*, 160*b*, 160*c*, or providing position information of the gripper 160*a* that is different than a reported position of the gripper 160*c*.

The LVDT sensor 190 can include a transducer electromagnetic core 192 that is stationary relative to the body 180 and can extend further into the bore 184 of the piston rod 182 as the piston rod 182 retracts from its fully extended position. A coil assembly in the transducer core 192 can detect the position of the piston rod 182 as it variably extends or retracts in the cavity 194 in the body 180. As the extension of the transducer core 192 varies within the bore 184, the transducer coil 192 correspondingly detects variations in its magnetic field, which can be interpreted to determine the position of the transducer core 192 relative to the piston rod 182. The transducer coil 192 can receive electrical energy via the connection 186 as well as communicate the sensor signal to the controller (e.g., controller 250) through the connection 186. The controller can provide proper signal conditioning for reading and processing the sensor signal. It should be understood that the torque actuator 108 can also include an LVDT sensor to detect and report the position of the actuator 108 and thus the position of the torque wrench 43 relative to the backup tong 41.

Figure 9A:
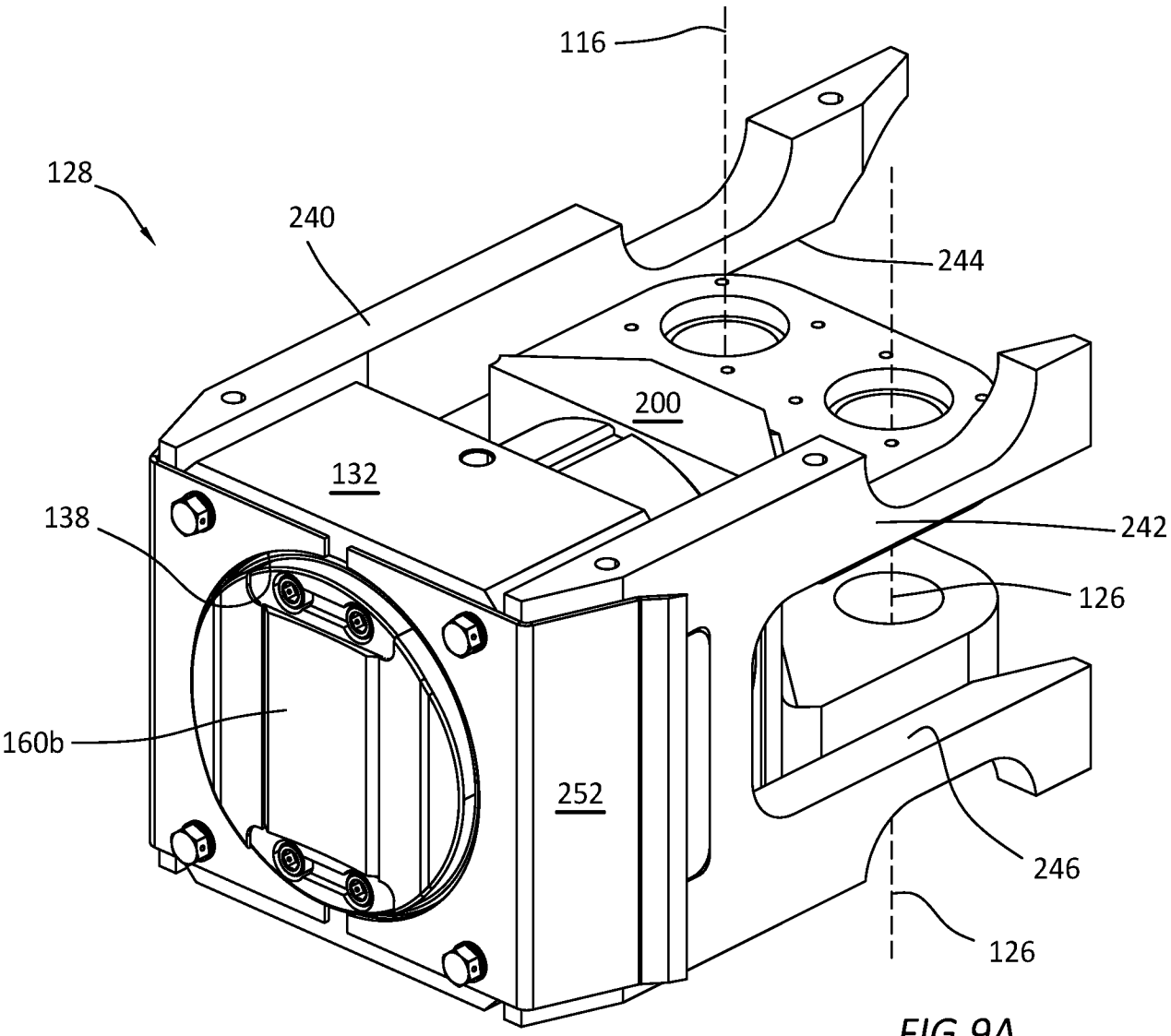
FIGS. 9A-9B are representative views of a center gripper assembly of the wrench, in accordance with certain embodiments.

FIG. 9A is a representative perspective view of a center gripper assembly 128 that can include a gripper 160*b* of the wrench 130. A piston assembly 200 slidingly engages a bore 138 in a support 132. The gripper 160*b* can be removably attached to the end of the piston assembly 200. The support 132 can be rigidly attached to the body 104 (or chassis 106) by support legs 240, 242. The support legs 240, 242 can have a respective recesses 244, 246 that allow clearance for the links 164, 174 to actuate the piston assembly 200 inward toward or outward away from the center axis 102 (not shown). The link 164 (not shown) can be rotationally coupled to the piston assembly 200 at the pivot axis 116. The link 174 (not shown) can be rotationally coupled to the piston assembly 200 at the pivot axis 126. A cover 252 can be used to protect and shield fasteners underneath that are used to fasten the support 132 in the center gripper assembly 128.

Figure 9B:
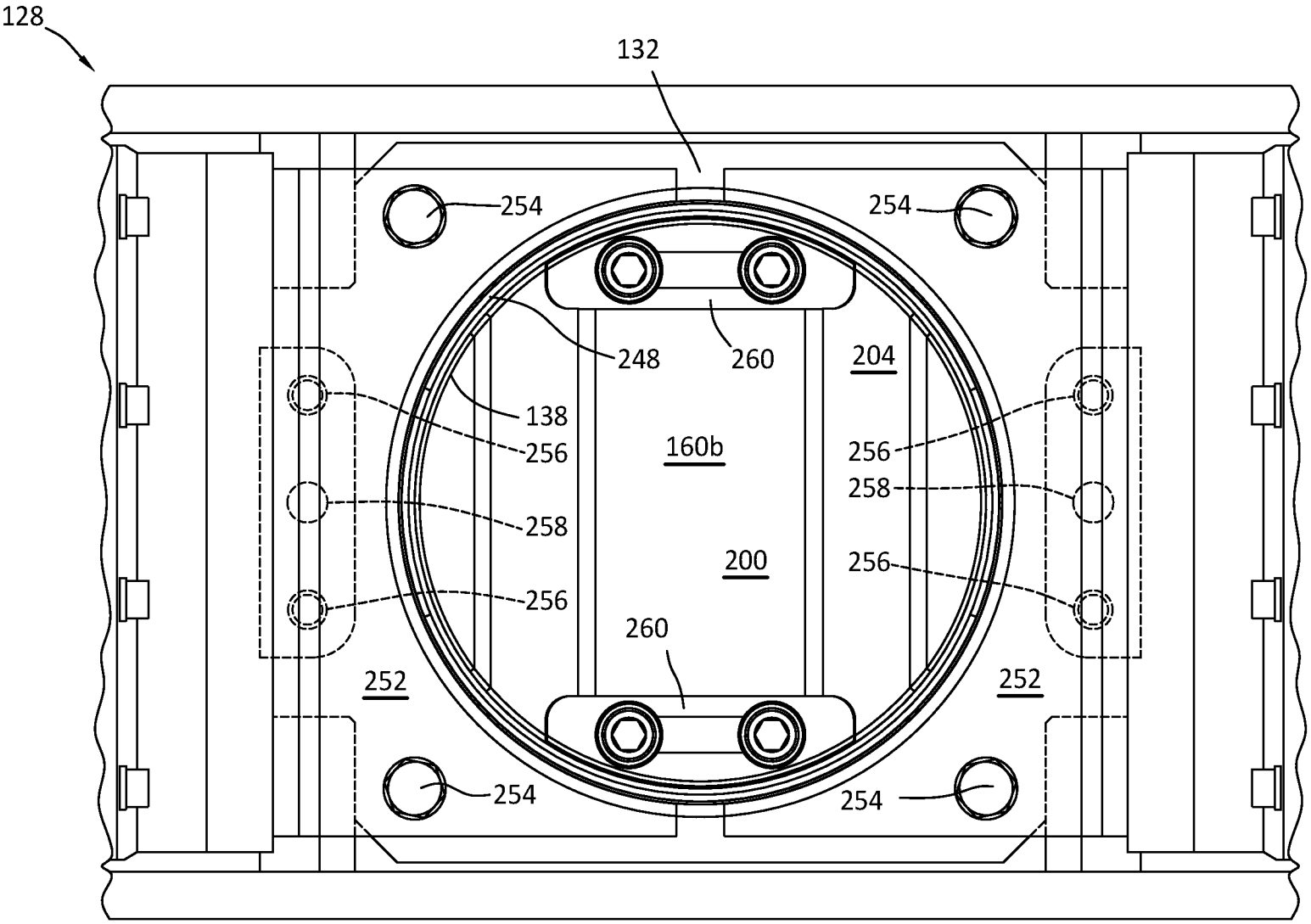

FIG. 9B is a representative front view of a center gripper assembly 128 that can include a gripper 160*b* of the wrench 130. The piston assembly 200 slidingly engages the bore 138 in the support 132. The center gripper assembly 128 provides for a simple and efficient way to remove and replace either the gripper 160*b*, the support 132 with the bore 138, or the piston body 204 of the piston assembly 200. To replace the gripper 160*b*, either one of the end retainers 260 can be removed by removing the fasteners that hold the retainers 260 to the piston body 204. The gripper 160*b* (or die 160*b*) can then be slid out of a dovetail shaped groove (see FIGS. 11B, 11C), then another gripper 160*b* can be slid into the dovetail shaped groove, and the end retainers 260 installed to retain the gripper 160*b* in the dovetail shaped groove.

To replace the support 132, the cover 252 can be removed to reveal fasteners 256 from underneath by removing the fasteners 254, which can be used to secure the cover 252 to the support 132. Removing the fasteners 256 can release the support 132 from the center gripper assembly 128 and allow removal of the support 132 from the center gripper assembly 128. If the support 132 has trouble releasing from the center gripper assembly 128 after the fasteners 256 are removed, back-out bolts (not shown) can be screwed into the threaded bores 258 to force the support 132 away from the center gripper assembly 128.

Figure 11A:
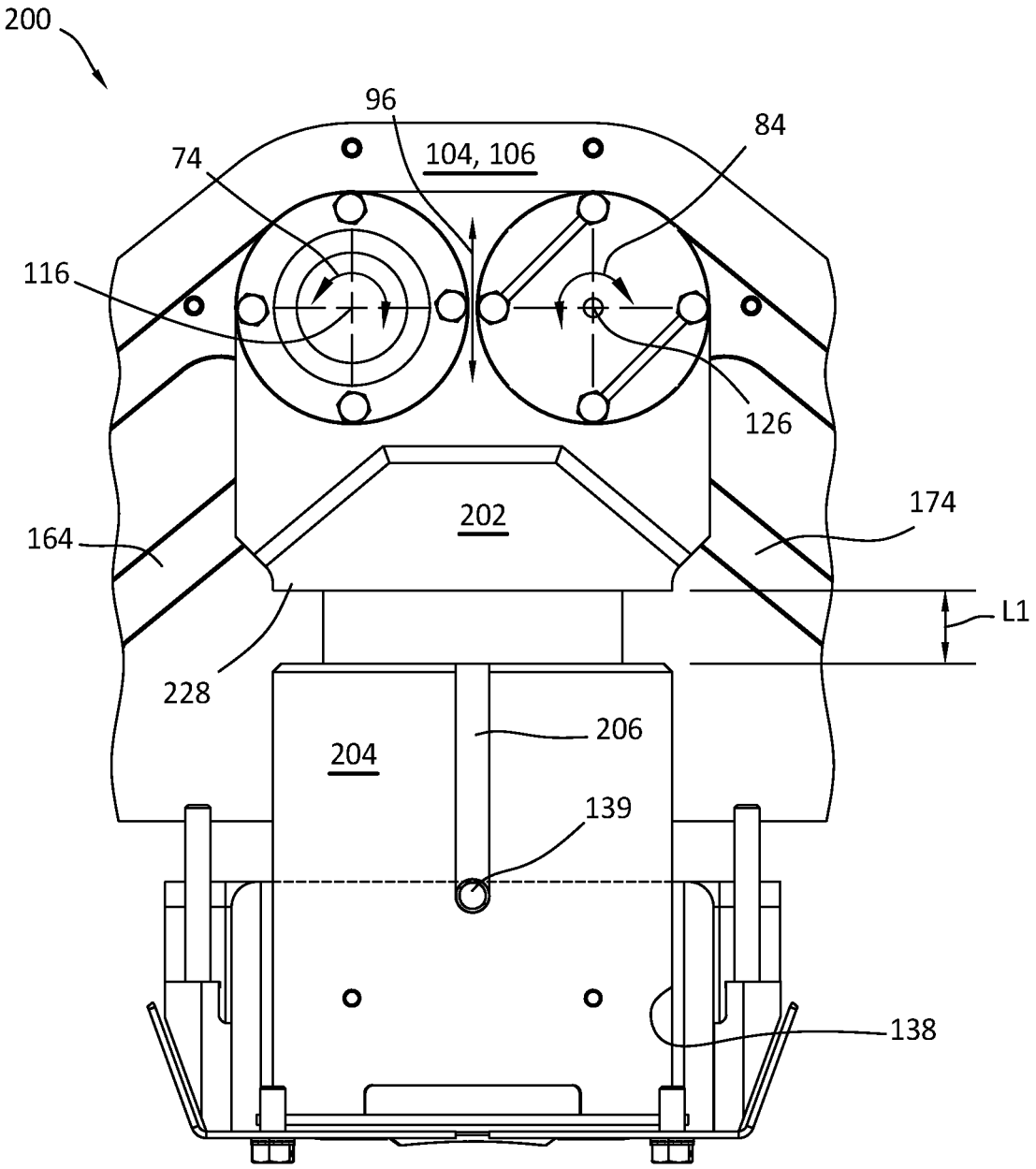
FIG. 11A is a representative top view of a piston assembly with a center gripper of the wrench in an extended position, in accordance with certain embodiments.
Figure 11B:
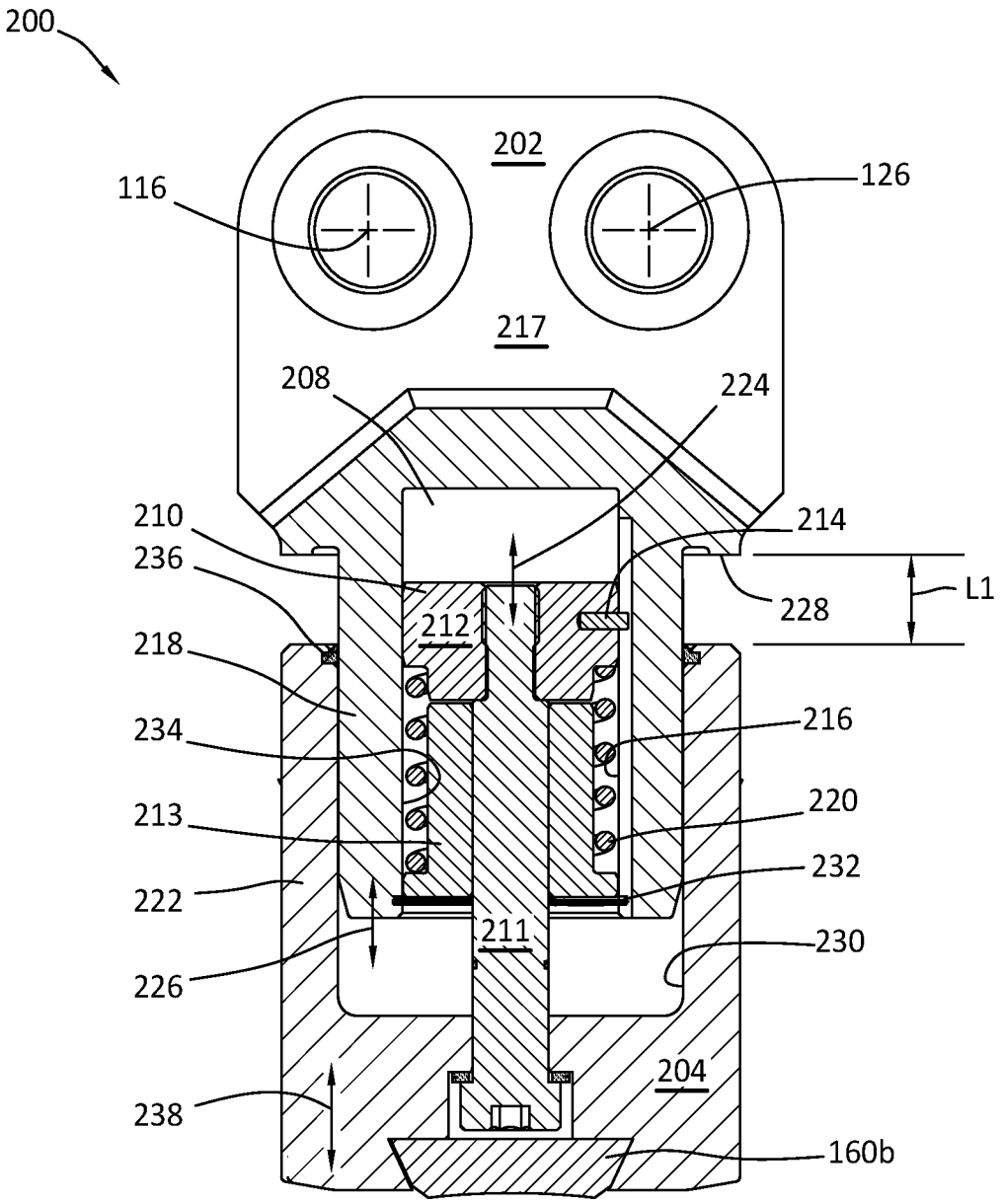
FIG. 11B is a representative perspective view of a piston assembly with a center gripper of the wrench in an extended position relative to the coupling, in accordance with certain embodiments.

With reference to FIG. 11B, the piston body 204 can be removed by removing the gripper 160*b* from the dovetail-shaped groove, and then unscrewing the piston rod 211 from the piston head 212. When the piston rod 211 is detached from the head 212, the piston rod 211 can be removed from the center gripper assembly 128 along with the piston body 204. A new piston body 204, with newly finished surfaces, can be installed in the center gripper assembly 128 by sliding the new piston body 204 over the extension 218 and into the bore 138 of the support 132. Therefore, if the bore 138 or the piston body 204 gets damaged, they can be easily replaced.

Figure 10B:
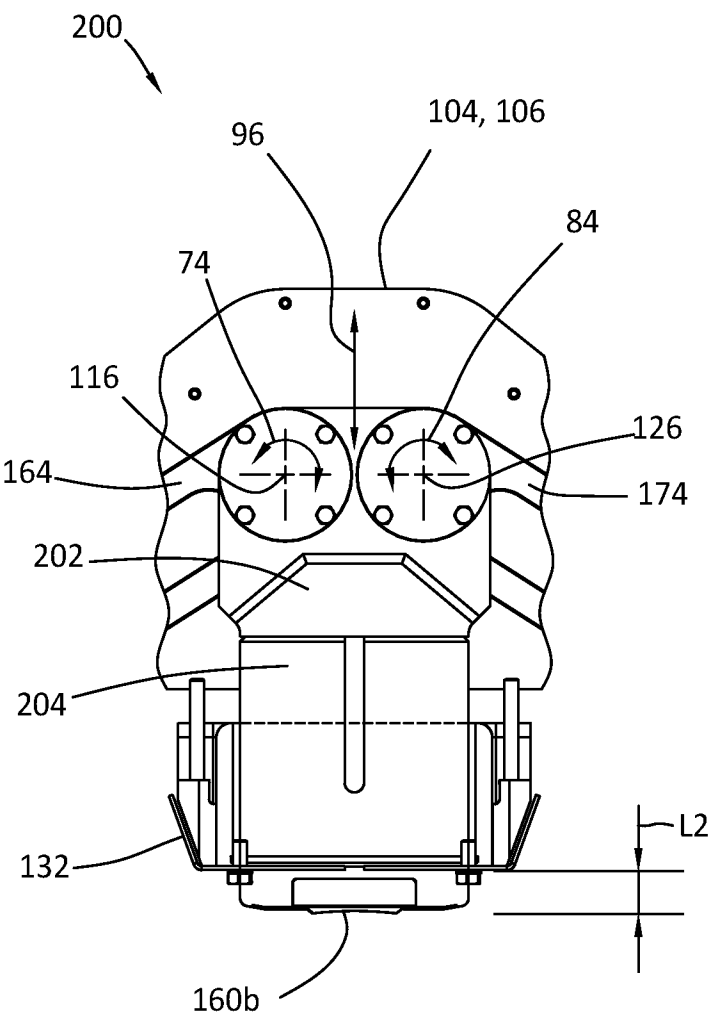
FIGS. 10A and 10B are a representative top view of a piston assembly with a center gripper of the wrench in retracted and extended positions, in accordance with certain embodiments.
Figure 10A:
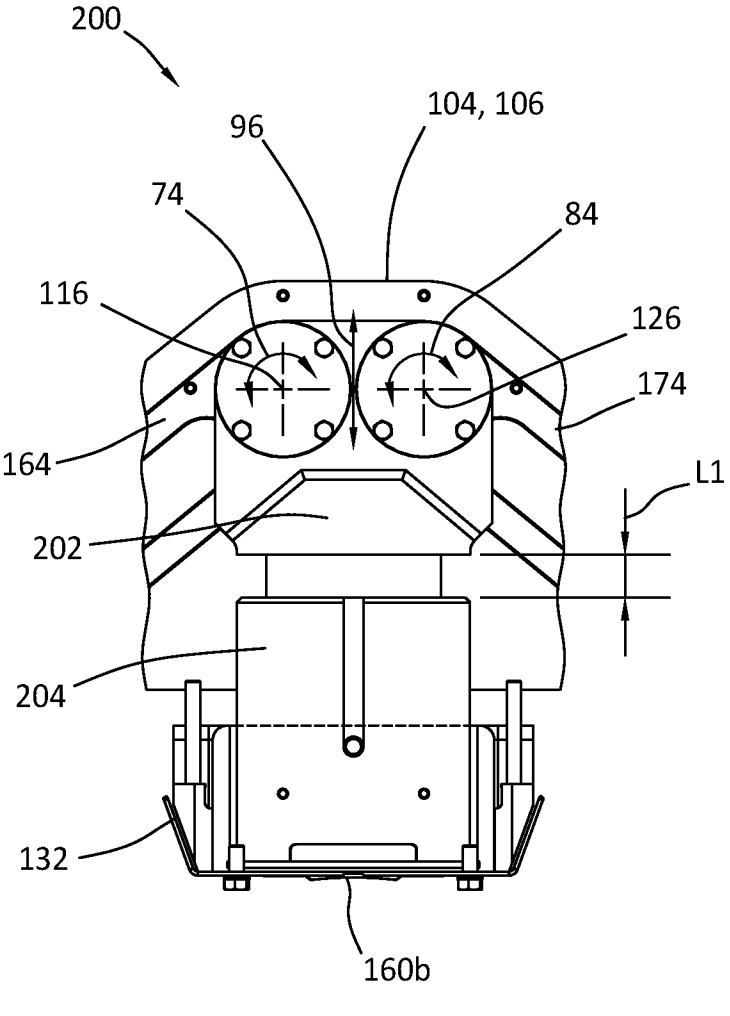

FIGS. 10A and 10B are a representative top view of a piston assembly 200 with a center gripper 160*b* of the wrench 130 in retracted and extended positions, in accordance with certain embodiments. FIG. 10A shows a shoulder of the coupling 202 to be spaced away from the piston 204 by a distance L1. When the wrench 130 is in a disengaged position (i.e., actuators 140, 150 retracted), the coupling 202 can be retracted from the piston 204 by a distance L1 to allow the piston 204 to stay positioned within the bore 138 of the support 132. The piston 204 can be prevented from retracting back past the end of the bore 138 that faces the center axis 102.

When the wrench 130 can be in an engaged position (i.e., actuators 140, 150 extended until grippers 160 engage the tubular joint 56), the coupling 202 can extend into the piston 204 until the shoulder of the coupling 202 engages the piston 204. As the links 164, 174 continue to move the coupling 202 further toward the center axis 102, the coupling 202 begins moving the piston 204 toward the center axis 102 such that the piston protrudes from the support 132 and extends to engage the tubular joint 56.

FIG. 10B shows the shoulder of the coupling 202 engaged with the piston 204 and a portion of the piston 204 extending past the support 132 a distance of L2. The distance L2 of the extension of the piston 204 from the support 132 can vary as the piston is selectively extended and retracted to engage or disengage a tubular joint 56.

FIG. 11A is a representative top view of a piston assembly 200 with a center gripper 160*b* of the wrench 130 in an extended position, in accordance with certain embodiments. When the wrench 130 is in a disengaged position (i.e., actuators 140, 150 retracted), the coupling 202 can be retracted from the piston 204 by a distance L1 to allow the piston 204 to stay positioned within the bore 138 of the support 132. The piston 204 can be prevented from retracting back past the end of the bore 138 that faces the center axis 102. The piston 204 can have a longitudinal channel 206 open at the top end of the piston and extending a desired distance along the outer surface of the piston 204. A protrusion 139 that protrudes inwardly from an inner surface of the bore 138 extends into the channel 206 and slides along within the channel 206 as the piston 204 moves in the bore 138. When the coupling 202 is moved up away from the center axis 102 a desired distance, the protrusion 139 will engage an end of the channel 206 and prevent further upward movement of the piston 204 in the bore 138. When the protrusion 139 engages the end of the channel 206, the coupling 202 can be moved further away from the center axis 102, thereby causing a gap L1 to form between the shoulder 228 of the coupling 202 and the piston 204. The protrusion 139 prevents the piston 204 from being retracted into the bore 138 and allowing debris to enter the bore 138. It should be understood that there can be one or more of the stops 139 with corresponding channels 206 in the body 204.

FIG. 11B is a representative perspective view of a piston assembly 200 with a center gripper 160*b* of the wrench 130 in an extended position relative to the coupling 202. The coupling 202 can include a head 217 that couples to the links 164, 174 at pivot axes 116, 1126, respectively. The coupling 202 can also include an extension 218 that extends into a bore 230 of a cylindrical body 222 of the body 204. The extension 218 can include an internal cavity 208, which can be cylindrically shaped, yet other cross-section shapes (e.g., square, hexagon, oval, pentagon, etc.) can also work. The preferred cross-section shape of the internal cavity 208 is a circular shape formed by a bore 234. The cavity 208 can include a longitudinal guide slot 216 formed in the inner surface of the bore 234. A piston 210 can extend into the cavity 208, the piston having a head 212 coupled to a piston rod 211 with the head 212 positioned in an upper portion of the cavity 208 and the piston rod 211 extending from the head 212, out of the cavity 208, and attached to the body 204. The head 212 can include a guide 214 that protrudes from an outer surface of the head 212 and extends into the guide slot 216. The guide 214 being engaged with the guide slot 216 prevents rotation of the piston 210 within the cavity 208, which assists in threading and unthreading the piston rod 211 into and out of the head 212 during assembly and disassembly procedures. It also prevents rotation of the head 212 relative to the extension 218 during operation.

The piston rod 211 extends through a sleeve 213 that is positioned in a lower portion of the cavity 208. A biasing device 220 can be disposed in an annulus formed between the sleeve 213 and the cavity 208 inner surface. The biasing device 220 acts on a shoulder of the sleeve 213 and on a shoulder of the head 212 to urge the head 212 away from the sleeve 213, such that force is required to engage the head 212 with the sleeve 213. The biasing device 220 can be preloaded with a compression force to urge the head 212 away from the sleeve 213. This can cause the body 204 to be engaged with the shoulder 228 of the coupling 202 as shown in FIG. 10B. Due to the force of the biasing device 220 acting on the head 212 and the sleeve 213, the body 204 should remain engaged with the shoulder 228, until the coupling is moved away from the center axis 102 of the wrench 130 a desired distance.

When the coupling 202 is moved away from the center axis 102 a desired distance, the stop 139 protruding from the bore 138 of the support 132 into the longitudinal slot 206 can engage the end of the slot 206 and prevent further upward movement (arrows 238) of the body 204 and thus prevent further upward movement (arrows 224) of the piston 210. The piston 210 is attached to the body 204, and so it is constrained to move with the body 204. As the coupling 202 moves further away from the center axis 102, the piston 210 compresses the biasing device 220 against the shoulder of the sleeve 213. The sleeve 213 can be held in the cavity by a retainer 232. The coupling 202 can move away from the center axis 102 until the piston head 212 engages the sleeve 213. It is preferred that at the height of the separation of the coupling 202 from the center axis 102, that a space between the piston head 212 and the sleeve 213 should remain. This will allow for manufacturing tolerances without causing unnecessary stress on the assembly 200. The seal 236 can prevent ingress of debris and fluids into the cavity 208. With the coupling 202 at the farthest distance from the center axis 102, the gap L1 between the shoulder 228 of the coupling 202 and the body 204 will be at its greatest distance.

When the actuators 140, 150 begin to extend, causing the grippers 160 to extend toward the center axis 102, the links 164, 174 coupled to the coupling 202 will begin to apply a downward force on the coupling 202. As the coupling 202 moves down, the extension 218 will move down (arrows 226) relative to the bore 230 of the body 204. As the coupling 202 moves down (arrows 226), the biasing device acting on the head 212 will cause the piston 210 to move up in the cavity 208 until the shoulder 228 engages the body 204, as seen in FIG. 11C.

Figure 11C:
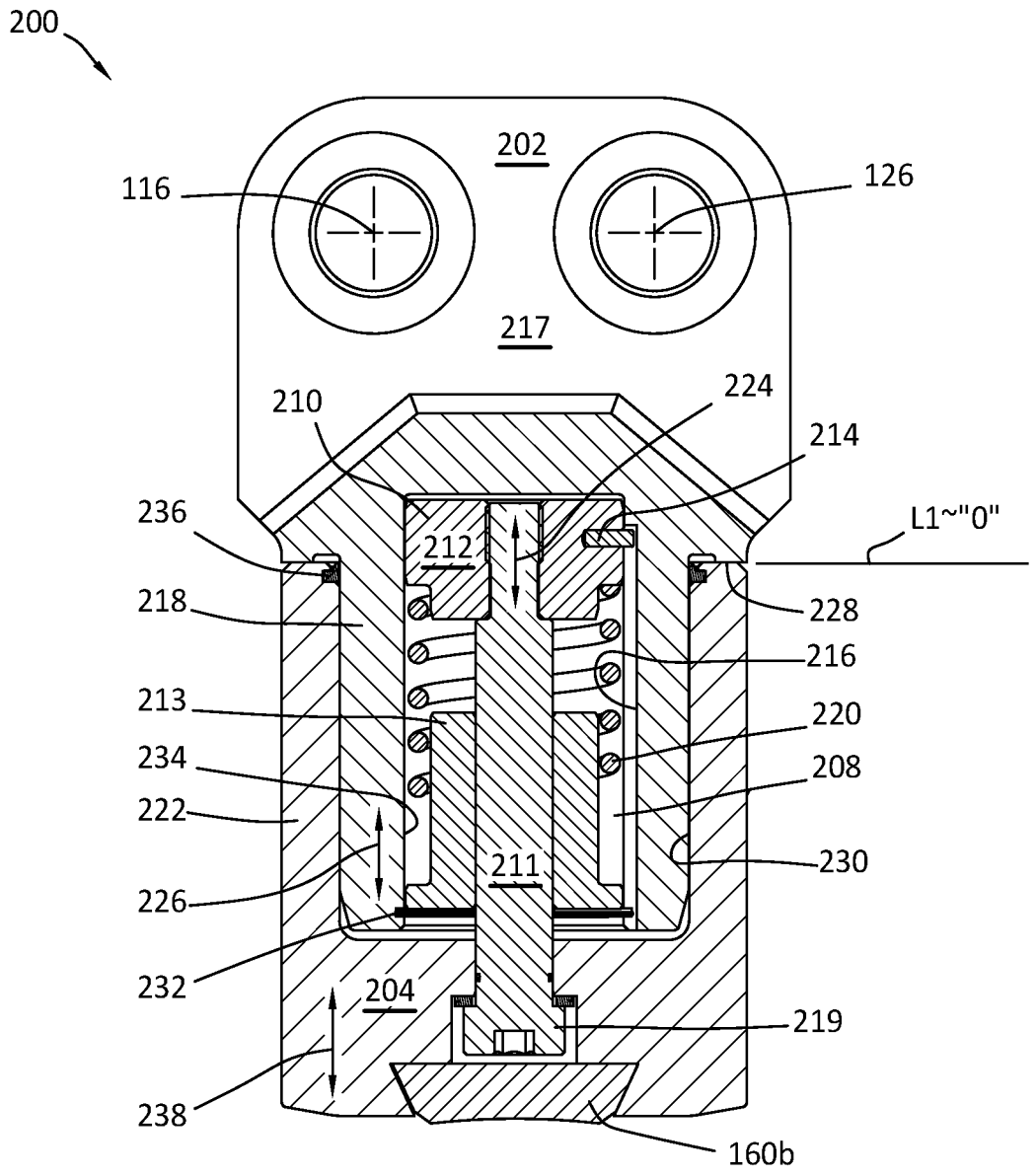
FIG. 11C is a representative perspective view of a piston assembly with a center gripper of the wrench in a retracted position relative to the coupling, in accordance with certain embodiments.

FIG. 11C is a representative perspective view of a piston assembly 200 with a center gripper 160*b* of the wrench 130 in a retracted position relative to the coupling 202. When the shoulder 228 is engaged with the body 204, further force applied by the links 164, 174 to the coupling 202 can move the piston assembly 200 further toward the center axis 102. The biasing device 220 will act to keep the shoulder 228 of the coupling 202 engaged with the body 204 before and after engagement of the gripper 160*b* with a tubular joint. During engagement of the gripper 160*b* with the tubular joint 56, the force applied from the links 164, 174, through the coupling 202, through the body 204, and through the gripper 160*b* to the tubular joint 56 will maintain the shoulder 228 engaged with the body 204 (i.e., L1 approximately equal to "0"). When the engagement of the gripper 160*b* with the tubular joint 56 is released, the biasing device will continue to hold the shoulder 228 engaged with the body 204 until the stop 139 engages the end of the slot 206, and the coupling 202 pulls away from the body 204, thus further compressing the biasing device 220.

Various Embodiments

Embodiment 1. A system for conducting a subterranean operation, the system comprising:

a wrench coupled to a rig floor, the wrench comprising:

a plurality of grippers;

a linkage mechanism that couples the plurality of grippers together; and a plurality of actuators coupled to the linkage mechanism, wherein the plurality of actuators apply a force to the linkage mechanism in opposite directions, and wherein the linkage mechanism is configured to evenly distribute the force between the plurality of grippers.

Embodiment 2. The system of embodiment 1, wherein the plurality of actuators is configured to extend the plurality of grippers radially inwardly into engagement with a tubular or retract the plurality of grippers radially outwardly away from engagement with the tubular.

Embodiment 3. The system of embodiment 1, wherein the plurality of actuators comprise a left actuator and a right actuator, and wherein the plurality of grippers comprise a left gripper, a right gripper, and a center gripper.

Embodiment 4. The system of embodiment 3, wherein the linkage mechanism comprises:

a left pivot arm rotationally coupled to a body of the wrench at a first pivot axis, with the left actuator rotationally coupled to the left pivot arm at a second pivot axis, wherein the second pivot axis is positioned in the left pivot arm at a shorter distance from the first pivot axis than a distance between the left gripper positioned on the left pivot arm and the first pivot axis.

Embodiment 5. The system of embodiment 4, wherein the linkage mechanism further comprises:

a right pivot arm rotationally coupled to the body of the wrench at a third pivot axis, with the right actuator rotationally coupled to the right pivot arm at a fourth pivot axis, wherein the fourth pivot axis is positioned in the right pivot arm at a shorter distance from the third pivot axis than a distance between the right gripper positioned on the right pivot arm and the third pivot axis.

Embodiment 6. The system of embodiment 5, wherein the center gripper is positioned on a piston of a piston assembly that is coupled to the left pivot arm, and the right pivot arm via the linkage mechanism, and wherein counterrotation of the left pivot arm relative to the right pivot arm moves the piston assembly toward or away from a center axis of an opening of the wrench.

Embodiment 7. The system of embodiment 3, wherein the left actuator is coupled to a left pivot arm and the right actuator is coupled to a right pivot arm, wherein the left pivot arm and the right pivot arm are coupled, via the linkage mechanism, to a coupling of a piston assembly.

Embodiment 8. The system of embodiment 7, wherein the wrench further comprises an opening configured to receive a tubular, the opening having a center axis, wherein a simultaneous extension of the left actuator and the right actuator moves the coupling toward the center axis of the opening, and wherein simultaneous retraction of the left actuator and the right actuator moves the coupling away from the center axis of the opening.

Embodiment 9. The system of embodiment 1, wherein the wrench further comprises a piston assembly coupled to the linkage mechanism, wherein extending the plurality of actuators moves the piston assembly toward a center axis of an opening in the wrench, wherein the wrench is configured to receive a tubular in the opening, and wherein retracting the plurality of actuators moves the piston assembly away from the center axis.

Embodiment 10. The system of embodiment 9, wherein the piston assembly comprises a piston and a coupling, and wherein the coupling is rotationally coupled to the linkage mechanism, and the piston is slidingly coupled to the coupling.

Embodiment 11. The system of embodiment 10, wherein a biasing device biases the piston toward a retracted position relative to the coupling and resists movement of the piston towards an extended position relative to the coupling.

Embodiment 12. The system of embodiment 11, wherein the coupling is moved toward the center axis when the plurality of actuators are extended, wherein the coupling is moved away from the center axis when the plurality of actuators are retracted.

Embodiment 13. The system of embodiment 12, wherein a stop prevents movement of the piston away from the center axis by a predetermined distance, wherein the biasing device allows the coupling to move relative to the piston when the stop engages the piston, and wherein the biasing device urges the piston toward the retracted position relative to the coupling.

Embodiment 14. A system for conducting a subterranean operation, the system comprising:

a wrench comprising:

a body having an opening configured to receive a tubular, the opening having a center axis;

a plurality of grippers circumferentially spaced apart around the opening;

a linkage mechanism that couples the plurality of grippers together;

a plurality of actuators coupled to the linkage mechanism; and a piston assembly coupled to the linkage mechanism, wherein the extension of the plurality of actuators moves the piston assembly, via the linkage mechanism, toward the center axis and retraction of the plurality of actuators moves the piston assembly, via the linkage mechanism, away from the center axis.

Embodiment 15. The system of embodiment 14, wherein the piston assembly comprises a piston and a coupling, and wherein the coupling is rotationally coupled to the linkage mechanism, and the piston is slidingly coupled to the coupling.

Embodiment 16. The system of embodiment 15, wherein a biasing device biases the piston toward a retracted position relative to the coupling and resists movement of the piston towards an extended position relative to the coupling.

Embodiment 17. The system of embodiment 16, wherein the coupling is moved toward the center axis when the plurality of actuators are extended, wherein the coupling is moved away from the center axis when the plurality of actuators are retracted.

Embodiment 18. The system of embodiment 17, wherein a stop prevents movement of the piston away from the center axis by a predetermined distance, wherein the biasing device allows the coupling to move relative to the piston when the stop engages the piston, and wherein the biasing device urges the piston toward the retracted position relative to the coupling.

Embodiment 19. The system of embodiment 14, wherein the plurality of actuators apply a force to the linkage mechanism in opposite directions, and wherein the linkage mechanism is configured to evenly distribute the force between the plurality of grippers.

Embodiment 20. A system for conducting a subterranean operation, the system comprising:

an iron roughneck that comprises a torque wrench and a backup tong, with each of the torque wrench and the backup tong comprising:

a body;

a plurality of grippers;

a linkage mechanism that couples the plurality of grippers together; and a plurality of actuators coupled to the linkage mechanism, with one of the plurality of grippers removably attached to a piston assembly, with the piston assembly comprising:

a piston slidably coupled to a bore of a support attached to the body, a coupling that couples the piston assembly to the linkage mechanism, the coupling being slidably coupled to the piston, and a biasing device that urges the piston toward the coupling, wherein the bore is configured to allow the piston to extend toward a center axis of an opening in the iron roughneck and prevent the piston from retracting more than a predetermined distance away from the center axis.

Embodiment 21. The system of embodiment 20, further comprising:

a longitudinal slot formed partially along an outer surface of the piston, and a protrusion that extends radially inward from an inner surface of the bore into the longitudinal slot of the piston, wherein the protrusion engages the longitudinal slot and is configured to allow the piston to extend toward the center axis and prevent the piston from retracting more than a predetermined distance away from the center axis.

Embodiment 22. The system of embodiment 20, wherein the plurality of actuators comprises a left actuator and a right actuator, and wherein the left actuator applies a force to the linkage mechanism in an opposite direction than a direction that the right actuator applies a force to the linkage mechanism.

Embodiment 23. The system of embodiment 20, wherein the plurality of actuators apply a force to the linkage mechanism in opposite directions, and wherein the linkage mechanism is configured to evenly distribute the applied force between the plurality of grippers.

Embodiment 24. A wrench assembly for performing a subterranean operation, the wrench assembly comprising:

a torque wrench comprising:

a body;

an opening in the body configured to receive a tubular, the opening having a center axis;

first, second, and third grippers positioned circumferentially around the opening and configured to engage the tubular;

a linkage mechanism that couples the first, second, and third grippers together, such that the linkage mechanism is configured to equalize a force applied to the tubular by each of the first, second, and third grippers when the first, second, and third grippers are engaged with the tubular; and first and second actuators positioned on opposite sides of the opening, with the first actuator rotationally attached to a left pivot arm of the linkage mechanism, and the second actuator rotationally attached to a right pivot arm of the linkage mechanism, wherein the first actuator extends toward the second actuator and the second actuator extends toward the first actuator to move the first, second, and third grippers, via the linkage mechanism, toward the center axis.

Embodiment 25. The wrench assembly of embodiment 24, wherein the first actuator retracts away from the second actuator and the second actuator retracts away from the first actuator to move the first, second, and third grippers, via the linkage mechanism, away from the center axis.

Embodiment 26. The wrench assembly of embodiment 24, wherein a left gripper is removably attached to the left pivot arm, a right gripper is removably attached to the right pivot arm, and a center gripper is removably attached to a piston of a piston assembly.

Embodiment 27. A method for making or breaking a joint in a tubular string, the method comprising:

receiving a joint of the tubular string into an opening of a roughneck, the opening having a center axis and the roughneck comprising a torque wrench and a backup tong, each comprising:

a plurality of grippers, a linkage mechanism that couples the plurality of grippers together, and left and right actuators coupled to the linkage mechanism;

extending the left and right actuators of the backup tong in opposite directions; thereby extending the plurality of grippers of the backup tong toward the center axis;

engaging the joint with the plurality of grippers of the backup tong; and equalizing, via the linkage mechanism, a gripping force supplied by each of the plurality of grippers of the backup tong to the joint.

Embodiment 28. The method of embodiment 27, further comprising:

extending the left and right actuators of the torque wrench in opposite directions; thereby extending the plurality of grippers of the torque wrench toward the center axis;

engaging the joint with the plurality of grippers of the torque wrench; and equalizing, via the linkage mechanism, a gripping force supplied by each of the plurality of grippers of the backup tong to the joint.

Embodiment 29. The method of embodiment 28, further comprising:

torquing the joint by actuating a torque actuator and rotating the torque wrench relative to the backup tong.

Embodiment 30. The method of embodiment 29, further comprising:

retracting the left and right actuators of the torque wrench in opposite directions; thereby retracting the plurality of grippers of the torque wrench away from the center axis; and disengaging the joint from the plurality of grippers of the torque wrench.

Embodiment 31. The method of embodiment 30, further comprising:

retracting both left and right grippers of the plurality of grippers of the torque wrench a first distance from the center axis; and retracting a center gripper of the plurality of grippers of the torque wrench away from the center axis a second distance, with the first distance being larger than the second distance.

Embodiment 32. The method of embodiment 30, further comprising:

retracting the left and right actuators of the backup tong in opposite directions; thereby retracting the plurality of grippers of the backup tong away from the center axis; and disengaging the joint from the plurality of grippers of the backup tong.

Embodiment 33. The method of embodiment 32, further comprising:

retracting both left and right grippers of the plurality of grippers of the backup tong a third distance from the center axis; and retracting a center gripper of the plurality of grippers of the backup tong away from the center axis, a fourth distance, with the third distance being larger than the fourth distance.

Embodiment 34. A system for conducting a subterranean operation, the system comprising:

a wrench coupled to a rig floor, the wrench comprising:

a plurality of grippers, comprising first, second, and third grippers, the second gripper configured to be mounted to a piston body having a longitudinal center axis;

a linkage mechanism that couples the plurality of grippers together; and a plurality of actuators coupled to the linkage mechanism, wherein each of the plurality of actuators applies a force to the linkage mechanism in a direction that is perpendicular to the longitudinal center axis, and wherein the linkage mechanism is configured to evenly distribute the force between the plurality of grippers.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for conducting a subterranean operation, the system comprising:

a wrench coupled to a rig floor, the wrench comprising:

a plurality of grippers;

a linkage mechanism that couples the plurality of grippers together;

a first actuator coupled to the linkage mechanism, wherein the first actuator applies a first force to the linkage mechanism in a first direction; and a second actuator coupled to the linkage mechanism, wherein the second actuator applies a second force to the linkage mechanism in a second direction that is opposite the first direction, and wherein the linkage mechanism is configured to distribute the first force and the second force between the plurality of grippers.

2. The system of claim 1, wherein the first and second actuators are configured to extend the plurality of grippers radially inwardly into engagement with a tubular or retract the plurality of grippers radially outwardly away from engagement with the tubular.

3. The system of claim 1, wherein the plurality of grippers comprise a left gripper, a right gripper, and a center gripper.

4. The system of claim 3, wherein the first actuator is coupled to a left pivot arm and the second actuator is coupled to a right pivot arm, wherein the left pivot arm and the right pivot arm are coupled, via the linkage mechanism, to a coupling of a piston assembly, and wherein the piston assembly is coupled to the center gripper.

5. The system of claim 4, wherein the wrench further comprises an opening configured to receive a tubular, the opening having a center axis, wherein simultaneous extension of the first actuator and the second actuator moves the coupling toward the center axis of the opening, and wherein simultaneous retraction of the first actuator and the second actuator moves the coupling away from the center axis of the opening.

6. The system of claim 1, wherein the wrench further comprises a piston assembly coupled to the linkage mechanism, wherein extending the first and second actuators moves the piston assembly toward a center axis of an opening in the wrench, and wherein retracting the first and second actuators moves the piston assembly away from the center axis.

7. The system of claim 6, wherein the piston assembly comprises a piston and a coupling, and wherein the coupling is rotationally coupled to the linkage mechanism and the piston is slidingly coupled to the coupling.

8. The system of claim 7, wherein a biasing device biases the piston toward a retracted position relative to the coupling and resists movement of the piston towards an extended position relative to the coupling.

9. The system of claim 8, wherein the coupling is moved toward the center axis when the first and second actuators are extended, and wherein the coupling is moved away from the center axis when the first and second actuators are retracted.

10. The system of claim 9, wherein a stop prevents movement of the piston away from the center axis by a predetermined distance, wherein the biasing device allows the coupling to move relative to the piston when the stop engages the piston, and wherein the biasing device urges the piston toward the retracted position relative to the coupling.

11. A system comprising:

an iron roughneck that comprises a torque wrench and a backup tong, with at least one of the torque wrench and the backup tong comprising:

a body;

a plurality of grippers;

a linkage mechanism that couples the plurality of grippers together; and a plurality of actuators coupled to the linkage mechanism, with one of the plurality of grippers removably attached to a piston assembly, with the piston assembly comprising:

a piston slidably coupled to a bore of a support attached to the body, a coupling that couples the piston assembly to the linkage mechanism, the coupling being slidably coupled to the piston, and a biasing device that urges the piston toward the coupling, wherein the bore is configured to allow the piston to extend toward a center axis of an opening in the iron roughneck and prevent the piston from retracting more than a predetermined distance away from the center axis.

12. The system of claim 11, further comprising:

a longitudinal slot formed partially along an outer surface of the piston, and a protrusion that extends radially inward from an inner surface of the bore into the longitudinal slot of the piston, wherein the protrusion engages the longitudinal slot and is configured to allow the piston to extend toward the center axis and prevent the piston from retracting more than a predetermined distance away from the center axis.

13. The system of claim 11, wherein the plurality of actuators comprises a left actuator and a right actuator, and wherein the left actuator applies a force to the linkage mechanism in an opposite direction than a direction that the right actuator applies a force to the linkage mechanism.

14. The system of claim 11, wherein the plurality of actuators apply a force to the linkage mechanism in opposite directions, and wherein the linkage mechanism is configured to evenly distribute the applied force between the plurality of grippers.

15. A method for making or breaking a joint in a tubular string, the method comprising:

receiving a joint of the tubular string into an opening of a roughneck, the opening having a center axis and the roughneck comprising a torque wrench and a backup tong, each comprising:

a plurality of grippers, a linkage mechanism that couples the plurality of grippers together, and left and right actuators coupled to the linkage mechanism;

extending the left and right actuators of the backup tong in opposite directions;

thereby extending the plurality of grippers of the backup tong toward the center axis;

engaging the joint with the plurality of grippers of the backup tong; and equalizing, via the linkage mechanism, a gripping force supplied by each of the plurality of grippers of the backup tong to the joint.

16. The method of claim 15, further comprising:

extending the left and right actuators of the torque wrench in opposite directions; thereby extending the plurality of grippers of the torque wrench toward the center axis;

engaging the joint with the plurality of grippers of the torque wrench;

equalizing, via the linkage mechanism, a gripping force supplied by each of the plurality of grippers of the torque wrench to the joint; and torquing the joint by actuating a torque actuator and rotating the torque wrench relative to the backup tong.

17. The method of claim 16, further comprising:

retracting the left and right actuators of the torque wrench in opposite directions; thereby retracting the plurality of grippers of the torque wrench away from the center axis; and disengaging the joint from the plurality of grippers of the torque wrench.

18. The method of claim 17, further comprising:

retracting both left and right grippers of the plurality of grippers of the torque wrench a first distance from the center axis; and retracting a center gripper of the plurality of grippers of the torque wrench away from the center axis a second distance, with the first distance being larger than the second distance.

19. The method of claim 17, further comprising:

retracting the left and right actuators of the backup tong in opposite directions; thereby retracting the plurality of grippers of the backup tong away from the center axis; and disengaging the joint from the plurality of grippers of the backup tong.

20. The method of claim 19, further comprising:

retracting both left and right grippers of the plurality of grippers of the backup tong a third distance from the center axis; and retracting a center gripper of the plurality of grippers of the backup tong away from the center axis a fourth distance, with the third distance being larger than the fourth distance.

* * * * *